US010746401B2

(12) United States Patent
Bøgh Andersen

(10) Patent No.: US 10,746,401 B2
(45) Date of Patent: Aug. 18, 2020

(54) MOVABLE GRATE FOR A FURNACE

(71) Applicant: Babcock & Wilcox Vølund A/S, Esbjerg (DK)

(72) Inventor: Hans Bøgh Andersen, Højbjerg (DK)

(73) Assignee: Babcock & Wilcox Vølund A/S, Esbjerg (DK)

( * ) Notice: Subject to any disclaimer, the term of this patent is extended or adjusted under 35 U.S.C. 154(b) by 48 days.

(21) Appl. No.: 16/303,183

(22) PCT Filed: Jul. 7, 2016

(86) PCT No.: PCT/IB2016/054082

§ 371 (c)(1),
(2) Date: Nov. 20, 2018

(87) PCT Pub. No.: WO2018/007854

PCT Pub. Date: Jan. 11, 2018

(65) Prior Publication Data

US 2019/0301734 A1 Oct. 3, 2019

(51) Int. Cl.

| | |
|---|---|
| ***F23K 3/08*** | (2006.01) |
| ***F23H 7/10*** | (2006.01) |
| ***F23H 17/08*** | (2006.01) |
| ***F23H 17/00*** | (2006.01) |

(52) U.S. Cl.

CPC ..... *F23H 7/10* (2013.01); *F23H 17/00* (2013.01); *F23H 17/08* (2013.01); *F23H 2900/03021* (2013.01)

(58) Field of Classification Search

CPC ..... F23H 17/08; F23H 17/04; F23H 17/02; F23H 9/12; F23H 9/00; F23H 9/06; F23H 7/10; F23H 17/00

See application file for complete search history.

(56) References Cited

U.S. PATENT DOCUMENTS

| | | | |
|---|---|---|---|
| 987,945 | A | 3/1911 | Benton |
| 3,057,309 | A | 10/1962 | Turner et al. |

FOREIGN PATENT DOCUMENTS

| | | | |
|---|---|---|---|
| GB | 1255555 | A | 12/1971 |
| WO | 8904441 | A1 | 5/1989 |
| WO | 9963270 | A1 | 12/1999 |

*Primary Examiner* — Jason Lau
(74) *Attorney, Agent, or Firm* — Dinsmore & Shohl LLP

(57) ABSTRACT

The grate includes a number of grate lanes arranged side by side between a left and a right side section, neighbouring lanes being connected by a midsection and including a lane section having a number of pivotal grate shafts carrying grate bars. Each midsection includes an upper relatively narrow housing section arranged between grate bars of neighbouring lanes and a lower relatively broad housing section protruding under grate bars of said lanes. The upper housing section of each midsection encloses bearings for grate shaft ends of neighbouring lanes. At least one midsection includes a drive mechanism for pivoting back and forth neighbouring grate shafts in opposite rotational directions and a synchronising mechanism of at least one lane section. An actuator of said drive mechanism and said synchronising mechanism are located in the lower housing section of said midsection.

27 Claims, 20 Drawing Sheets

MOVABLE GRATE FOR A FURNACE

REFERENCE TO RELATED APPLICATION

This application is a U.S. national stage of PCT/IB2016/054082, filed Jul. 7, 2016, the entire content of which is incorporated herein by reference.

FIELD OF THE INVENTION

The present invention relates to a movable grate for a furnace including a number of grate lanes arranged side by side between a left side section and a right side section, neighbouring grate lanes being connected by means of a midsection, each grate lane including at least one lane section having a number of pivotal grate shafts carrying grate bars and thereby defining an inclined grate surface of said lane section, each midsection including an upper relatively narrow housing section arranged between grate bars of the corresponding neighbouring grate lanes and a lower relatively broad housing section protruding at least partly under grate bars of said corresponding neighbouring grate lanes, each grate shaft having a driven grate shaft end and a non-driven grate shaft end, each grate shaft end being journalled in a respective bearing, the left and right side sections enclosing bearings for corresponding grate shaft ends of the left and right outermost grate lanes, respectively, and the upper relatively narrow housing section of each midsection enclosing bearings for corresponding grate shaft ends of corresponding neighbouring grate lanes, each lane section being provided with a drive mechanism including an actuator for pivoting back and forth neighbouring grate shafts in opposite rotational directions so as to impart a wave-like movement to material on the grate surface in order to transport such material downwards, a synchronising mechanism being arranged to maintain a predetermined clearance between edge portions of grate bars of neighbouring grate shafts.

BACKGROUND OF THE INVENTION

GB 1 255 555 A discloses a movable grate, for a furnace or an incinerator, in the form of steps, wherein each step is rockable by a drive mechanism to impart a wave-like motion to the material on the grate. Synchronizing means between juxtaposed steps maintains a predetermined clearance between the adjoining edge portions of those steps. The grate is divided into an upper and lower section, there being a drive mechanism for each section and each section has a different rate of movement.

WO 89/04441 discloses a movable grate comprising a number of grate steps which are arranged adjacent each other, partly overlap one another and are pivotal about an axis extending in the longitudinal direction of said grate step, and which are pivotally mounted outside shield members which in lateral direction enclose a combustion chamber. End plates are rigidly secured to the ends of the grate steps and pivotal therewith; the end plates being aligned with and fitted in openings in the shield members. Portions of the shield members having openings aligned with the end plates are displaceably mounted relative to adjoining shield members in the direction of the grate step axis, and the shield portions which radially outwardly sealingly engage adjoining shield members and radially inwardly sealingly engage the end plates, are in the direction of said axis held in a fixed position in relation to the grate step shaft.

WO 99/63270 discloses a grate device for a combustion furnace comprising a grate element and a turnable shaft assembly connected thereto. The grate element has a first system of ducts for circulating coolant through the grate element. The shaft assembly has a second system of ducts, which communicates with the first system of ducts and forms a coolant inlet and outlet. The grate element comprises a girder means which is non-rotatably connected with the shaft assembly and which contains a part of the first system of ducts, which part communicates with the second system of ducts. The grate element comprises a plate means which is mounted on the girder means and forms a grate area and through which the remaining part of the first system of ducts extends for cooling the grate area.

In these known devices, the grate bars on each grate shaft coincide with the grate bars on the neighbouring shaft without touching these, thereby forming a cohesive grate surface. The gap between two coinciding grate bars may for instance be approximately 1 to 3 millimetres. The grate function is such that the grate shafts alternately turn to their respective outer positions, and the grate surface thus forms a stair-shaped surface where the steps change direction. This produces a rolling movement to material present on the grate, which may have the effect of breaking it up and agitating it, while at the same time moving it forward in downward direction, thus achieving good exposure to radiant heat from a combustion chamber and good exposure to combustion air.

In addition to the above-mentioned grate devices, devices are known, wherein two grates of the above described type are arranged side by side and so that the grate device is composed by two grate lanes connected by means of a midsection. Thereby, the two grate lanes are arranged symmetrically so that the drive mechanisms are arranged along the outer free sides of the arrangement in order to provide for a slim midsection between the two grate lanes and in order to ensure easy access in connection with service and maintenance. In this way, a larger grate width and better flexibility may be obtained. The latter may be achieved due to the possibility of operating each grate lane independently, whereby the individual speeds of the grate lanes may be adapted to the amount of material present of the individual grate lanes. However, in these devices it is of importance that the midsection is relatively slim, because the midsection does not provide any movement to material present thereon, and no exposure to heat or combustion air is provided thereby. Furthermore, it is of importance that the drive mechanisms are not freely exposed under the grate lanes in order to reduce maintenance and in order to provide access to the drive mechanisms even during operation of the furnace, in the case that maintenance is necessary.

In order to achieve even larger grate widths and good flexibility, it would be desirable to combine even more than two grate lanes into one unit.

SUMMARY OF THE INVENTION

The object of the present invention is to provide a type of movable grate suitable for the arrangement of more than two grate lanes side by side close to each other while still providing good accessibility in connection with service and maintenance.

In view of this object, at least one midsection includes the drive mechanism and the synchronising mechanism of at least one lane section, and the actuator of said drive mechanism and said synchronising mechanism are located in the lower relatively broad housing section of said at least one midsection.

Thereby, by locating the actuator of said drive mechanism and said synchronising mechanism in the lower relatively broad housing section of said at least one midsection, it is possible to incorporate a drive mechanism in the midsection while maintaining a relatively narrow upper midsection and also providing good access to drive mechanism and synchronising mechanism during service and maintenance.

In an embodiment, in the at least one midsection including the drive mechanism and the synchronising mechanism of the at least one lane section, the mutual relative pivotal positions of the respective grate shafts of the at least one lane section are individually adjustable by means of respective clearance adjustment mechanisms located in the lower relatively broad housing section of said at least one midsection. Thereby, by locating the respective clearance adjustment mechanisms in the lower relatively broad housing section, the clearance adjustment mechanisms may be easily accessible, thereby facilitating service and maintenance.

In an embodiment, in the at least one midsection including the drive mechanism and the synchronising mechanism of the at least one lane section, the mutual relative pivotal positions of the respective grate shafts of the at least one lane section are individually elastically biased towards respective predetermined relative pivotal positions by means of respective biasing mechanisms located in the lower relatively broad housing section of said at least one midsection. Thereby, if the movement of a grate shaft is prevented, the movement may wholly or partly be taken up by the biasing mechanisms. Furthermore, by locating the respective biasing mechanisms in the lower relatively broad housing section, the biasing mechanisms may be easily accessible, thereby facilitating service and maintenance.

In an embodiment, in the at least one midsection including the drive mechanism and the synchronising mechanism of the at least one lane section, a number of drive shafts corresponding to the respective grate shafts of the at least one lane section are located in the lower relatively broad housing section of said at least one midsection, and the driven grate shaft end of each said grate shaft is individually in driven connection with a corresponding one of said drive shafts. Thereby, by driving each grate shaft independently by means of a respective drive shaft located in the lower relatively broad housing section of the midsection, the movement of each grate shaft may be controlled independently from an easily accessible location, thereby facilitating precise control and adjustment of the movement of each separate grate shaft in connection with service and maintenance.

In a structurally particularly advantageous embodiment, the driven grate shaft end of the respective grate shafts of the at least one lane section is provided with a respective grate shaft lever arm, a first end of the grate shaft lever arm is in driving connection with the grate shaft and a second end of the grate shaft lever arm is pivotally connected to a first end of a corresponding connection rod extending down into the lower relatively broad housing section of said at least one midsection, and a second end of said connection rod located in said relatively broad housing section is in driven connection with the actuator of said drive mechanism. Thereby, by driving each grate shaft by means of a connection rod, a precise transmission of the movement from the actuator to the grate shaft is possible. Furthermore, by driving each grate shaft independently by means of a respective connection rod extending down into the lower relatively broad housing section of the midsection, the movement of each grate shaft may be controlled independently from an easily accessible location, thereby facilitating precise control and adjustment of the movement of each separate grate shaft in connection with service and maintenance.

In an embodiment, the driven connection between the second end of said respective connection rods and the actuator of said drive mechanism is individually adjustable in order to adjust the individual predetermined clearance between edge portions of grate bars of neighbouring grate shafts. Thereby, the adjustment of the driven connection may be performed in the lower relatively broad housing section, thereby facilitating adjustment of clearance in connection with service and maintenance.

In an embodiment, the driven grate shaft end of each said grate shaft is provided with a grate shaft lever arm, a first end of the grate shaft lever arm is in driving connection with the grate shaft and a second end of the grate shaft lever arm is pivotally connected to a first end of a corresponding connection rod, each said drive shaft is provided with a drive shaft lever arm, and a first end of the drive shaft lever arm is in driven connection with the drive shaft and a second end of the drive shaft lever arm is pivotally connected to a second end of a corresponding connection rod so that each grate shaft lever arm is connected with a corresponding drive shaft lever arm by means of a corresponding connection rod. Thereby, by driving each grate shaft by means of a connection rod, a precise transmission of the movement from the actuator to the grate shaft is possible. Furthermore, by driving each grate shaft independently by means of a respective connection rod extending down into the lower relatively broad housing section of the midsection, the movement of each grate shaft may be controlled independently from an easily accessible location, thereby facilitating precise control and adjustment of the movement of each separate grate shaft in connection with service and maintenance.

In an embodiment, each connection rod is pivotally connected to the corresponding grate shaft lever arm by means of a first ball joint, and each connection rod is pivotally connected to the corresponding drive shaft lever arm by means of a second ball joint. Thereby, a more flexible connection between the grate shaft lever arm and the corresponding drive shaft lever arm may be achieved. Furthermore, it may be possible to employ standard ball joints which are fully sealed and do not require any service for an extended period of time. This may be advantageous, especially in relation to ball joints located in the upper relatively narrow housing section where accessibility may be restricted. Furthermore, a ball joint may be better suitable for rocking motion back and forth as compared to standard ball bearings and may therefore last longer.

In a structurally particularly advantageous embodiment, the grate shafts of said at least one lane section are numbered consecutively in downward direction, the corresponding drive shafts are numbered correspondingly, each drive shaft is provided with a crank arm, the crank arms of drive shafts having odd numbers are connected by means of a first linking rod and the crank arms of drive shafts having even numbers are connected by means of a second linking rod, the actuator of said drive mechanism is a linear actuator, such as a hydraulic piston actuator, and the first linking rod and the second linking rod are interconnected by means of the linear actuator.

In an embodiment, each crank arm is mounted pivotally adjustably on the corresponding drive shaft. Thereby, the adjustment of the driven connection may be performed in the lower relatively broad housing section, thereby facilitating adjustment of clearance in connection with service and maintenance.

In an embodiment, each crank arm is mounted on the corresponding drive shaft elastically biased towards a predetermined relative pivotal position in relation to said drive shaft.

Thereby, if the movement of a grate shaft is prevented, the movement may wholly or partly be taken up by the elastic biasing mechanisms. Furthermore, by locating the respective elastic biasing mechanisms in the lower relatively broad housing section, the biasing mechanisms may be easily accessible, thereby facilitating service and maintenance.

In a structurally particularly advantageous embodiment, one of the drive shafts having odd numbers is connected to one of the drive shafts having even numbers by means of the synchronising mechanism of at the least one lane section.

In a structurally particularly advantageous embodiment, said synchronising mechanism includes a first synchronising lever arm having a first end fixedly connected to said one of the drive shafts having odd numbers and a second end pivotally connected to a first end of a synchronising rod and a second synchronising lever arm having a first end fixedly connected to said one of the drive shafts having even numbers and a second end pivotally connected to a second end of the synchronising rod.

In an embodiment, at least one midsection includes axially displaceable bearings in which corresponding grate shaft ends of at least one lane section are journalled, each said axially displaceable bearing is mounted in a displaceable bearing house mounted displaceably in relation to a stationary bearing house support mounted in fixed relationship to said at least one midsection so that said displaceable bearing house is displaceable in the axial direction of the corresponding grate shaft and fixed against rotation about said axial direction, a non-pivotal side cover plate is coupled to and axially displaceable with said displaceable bearing house, the non-pivotal side cover plate forms part of a side wall of the upper relatively narrow housing section of said at least one midsection including axially displaceable bearings, and the non-pivotal side cover plate is mounted in proximity to the outermost grate bars carried by the grate shafts of said at least one lane section. Thereby, axial displacements of grate shaft ends resulting from temperature changes of the grate shafts may be allowed for without changing the clearance between the non-pivotal side cover plate and the outermost rocking grate bars, thereby ensuring better control of the supply of combustion air. Furthermore, by coupling the non-pivotal side cover plate to the axially displaceable bearing house, a very slim midsection may be achieved even with displaceable non-pivotal side cover plates.

In a structurally particularly advantageous embodiment, the displaceable bearing house has an outer cylindrical surface arranged slidingly in a cylindrical boring in the stationary bearing house support.

In an embodiment, a pivotal side cover plate is fixed on each said grate shaft end journalled in an axially displaceable bearing, the pivotal side cover plate forms part of said side wall of the upper relatively narrow housing section, and the pivotal side cover plate is arranged pivotally in a cut-out of the corresponding non-pivotal side cover plate so that an outer edge of the pivotal side cover plate forming an arc of a circle is in close proximity to a corresponding inner edge of the cut-out of the corresponding non-pivotal side cover plate forming a corresponding arc of a circle. Thereby, a relatively tight connection may be formed between the non-pivotal side cover plate and the grate shaft end.

In a structurally particularly advantageous embodiment, the axially displaceable bearings are arranged at non-driven grate shaft ends. Depending on the drive mechanism, it may be advantageous that the driven grate shaft ends do not move in axial direction.

In a structurally particularly advantageous embodiment, in the at least one midsection including the drive mechanism and the synchronising mechanism of the at least one lane section, a stationary frame of said midsection is formed by means of two spaced grate beams extending in the longitudinal direction of said midsection in the lower relatively broad housing section of said midsection, two grate plates in the form of longitudinal L-formed brackets are mounted with a first lower flange on top of the respective spaced grate beams and with a second upright flange extending vertically, and bearing houses arranged in said midsection are carried by the respective second upright flanges of the two longitudinal L-formed brackets. Thereby, an especially narrow housing section of the midsection may be achieved.

In an embodiment, in the at least one midsection including the drive mechanism and the synchronising mechanism of the at least one lane section, a dust shield is arranged inside an outer enclosure of the at least one midsection, non-displaceable bearing houses or stationary bearing house supports carrying bearings in which respective driven grate shaft ends are journalled extend sealingly through respective openings in the dust shield, the dust shield thereby separates the inside of the outer enclosure of the at least one midsection into an outer room section next to the outer enclosure and an inner room section enclosing the drive mechanism including the actuator and the synchronising mechanism of at least one lane section. Thereby, the drive mechanism including the actuator and the synchronising mechanism may be even better protected against dust and dirt possibly entering through leaks from the combustion chamber. Thereby, maintenance costs may be reduced.

In an embodiment, the outer room section is connected to a supply of pressurised sealing gas. Thereby, an overpressure in relation to the pressure in the combustion chamber may be created in the outer room section, thereby even better preventing dust and dirt from possibly entering through leaks from the combustion chamber into the outer room section. The outer room section may thereby create a barrier between the combustion chamber and the inner room section, thereby even better preventing dust and dirt from possibly entering the inner room section enclosing the drive mechanism including the actuator and the synchronising mechanism. Thereby, maintenance costs may be even more reduced.

In a structurally particularly advantageous embodiment, the dust shield includes a bottom wall extending between the two spaced grate beams, two spaced side walls extending from the bottom wall to a top part of the upper relatively narrow housing section of said midsection and a top wall connecting the two spaced side walls, non-displaceable bearing houses or stationary bearing house supports carrying bearings in which respective grate shaft ends are journalled extends sealingly through openings in the respective two spaced side walls, and the drive mechanism of the at least one lane section extends through an opening in the bottom wall.

In a structurally particularly advantageous embodiment, the two spaced grate beams forming the stationary frame of said midsection have the form of hollow rectangular tubes, the inside of the hollow rectangular tubes are connected to a supply of pressurised sealing gas, and the pressurised sealing gas is supplied to the outer room section from the inside of the hollow rectangular tubes through holes in the walls of the hollow rectangular tubes.

In an embodiment, at least some of the grate bars of at least one grate lane extending between two midsections are adapted to be cooled by means of circulating cooling fluid, a cooling fluid supply channel is formed as an axial bore in an inlet end of the grate shafts carrying grate bars and a cooling fluid outlet channel is formed as an axial bore in an outlet end of the grate shafts carrying grate bars, the cooling fluid supply channels are connected to respective cooling fluid supply tubes extending in one of the two midsections, and the cooling fluid outlet channels are connected to respective cooling fluid return tubes extending in the other of the two midsections. Thereby, the service life of the grate bars may be extended substantially. By leading the cooling fluid in from one end of the grate shafts and out of the other end, an even better cooling effect may be achieved than that compared to known devices having inlet and outlet at one single end of the grate shafts.

In an embodiment, the non-pivotal side cover plates forming part of the side wall of the upper relatively narrow housing section of said at least one midsection and a top wall of said upper relatively narrow housing section are adapted to be cooled by means of circulating cooling fluid. Thereby, the service life of the grate shaft bearings and the drive mechanisms may be extended substantially.

In an embodiment, the left side section and the right side section include the drive mechanisms and the synchronising mechanisms of at least one lane section of the left outermost grate lane and of at least one lane section of the right outermost grate lane, respectively, the grate shafts of said at least one lane section of the left outermost grate lane and of said at least one lane section of the right outermost grate lane, respectively, are numbered consecutively in downward direction, each grate shaft is provided with a crank arm, the crank arms of grate shafts having odd numbers are connected by means of a first linking rod and the crank arms of grate shafts having even numbers are connected by means of a second linking rod, the actuator of said drive mechanism is a linear actuator, such as a hydraulic piston actuator, and the first linking rod and the second linking rod are interconnected by means of the linear actuator. Thereby, the same or corresponding drive mechanisms may be employed for both side sections and midsections, thereby reducing the number of different components.

In a structurally particularly advantageous embodiment, the movable grate includes a first grate lane, a second grate lane, and a third grate lane, the left side section and the right side section includes axially displaceable bearings for driven grate shaft ends of the first and third grate lanes, respectively, a first midsection includes axially non-displaceable bearings for non-driven grate shaft ends of the first grate lane and axially displaceable bearings for non-driven grate shaft ends of the second grate lane, and a second midsection includes axially non-displaceable bearings for driven grate shaft ends of the second grate lane and axially non-displaceable bearings for non-driven grate shaft ends of the third grate lane.

In a structurally particularly advantageous embodiment, the movable grate includes a first grate lane, a second grate lane, a third grate lane, and a fourth grate lane, the left side section and the right side section encloses axially displaceable driven grate shaft ends of the first and fourth grate lanes, respectively, a first midsection includes axially non-displaceable bearings for non-driven grate shaft ends of the first grate lane and axially displaceable bearings for non-driven grate shaft ends of the second grate lane, a second midsection includes axially non-displaceable bearings for driven grate shaft ends of the second grate lane and axially displaceable bearings for non-driven grate shaft ends of the third grate lane, and a third midsection includes axially non-displaceable bearings for driven grate shaft ends of the third grate lane and axially non-displaceable bearings for non-driven grate shaft ends of the fourth grate lane.

DETAILED DESCRIPTION OF THE INVENTION

Figure 1:
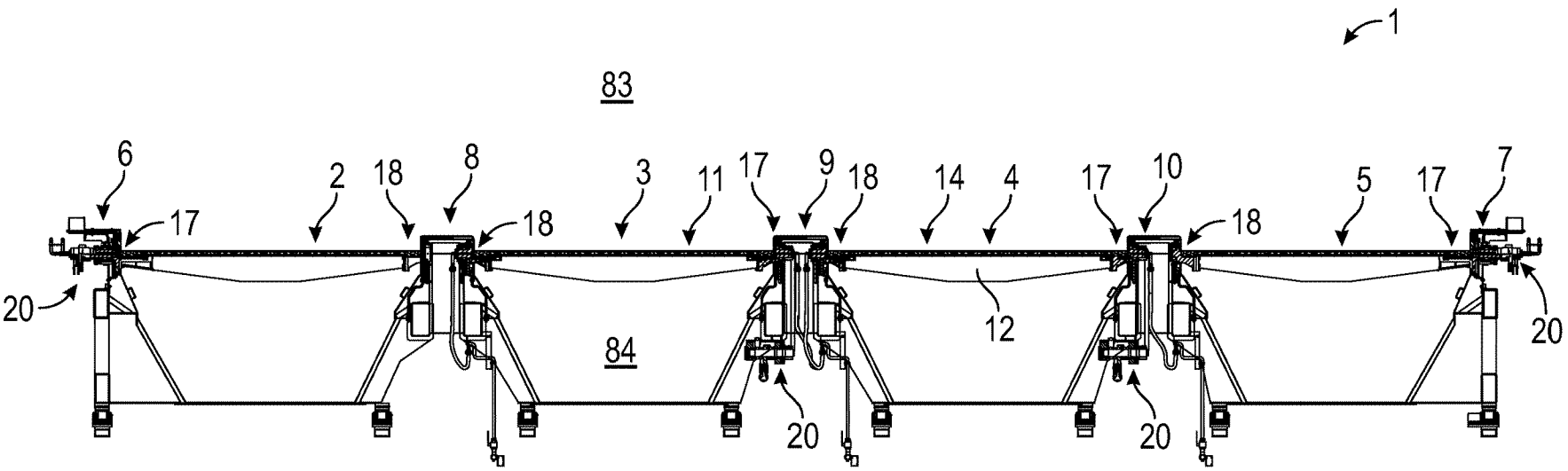
FIG. 1 is a cross-section through an embodiment of a movable grate for a furnace according to the invention, seen from the upper end of the movable grate.

FIGS. 1 to 5 illustrate a movable grate 1 for a furnace according to the invention. The movable grate 1 has a combustion chamber 83 and includes four grate lanes 2, 3, 4, 5 arranged side by side between a left side section 6 and a right side section 7. Neighbouring grate lanes 2, 3, 4, 5 are connected by means of respective midsections 8, 9, 10, and each grate lane 2, 3, 4, 5 includes a number of lane sections 11 having a number of pivotal grate shafts 12 carrying water cooled or air cooled grate bars 13 and thereby defining an inclined grate surface 14 of said lane section. In FIGS. 6A and 6B, one lane section 11 having six pivotal grate shafts $\mathbf{12}_1$, $\mathbf{12}_2$, $\mathbf{12}_3$, $\mathbf{12}_4$, $\mathbf{12}_5$, $\mathbf{12}_6$ arranged parallelly in spaced configuration is illustrated. Typically, each grate lane may include four lane sections 11 arranged one after the other in the longitudinal direction of the lane sections 11, but any suitable number of grate lanes is possible. The lane sections 11 of each grate lane may be separated by means of not shown section dividers which may include stationary grate bars. Thereby, it may be possible to regulate the transport speed of the different lane sections 11 independently, whereby the transport speed may be adapted to the actual needs. The lane sections 11 of each grate lane 2, 3, 4, 5 form an inclined grate lane extending downwards from a not shown start section to a not shown end section. The start section connects a not shown feeder to the grate lane, and the end section ends the grate lane at a not shown bottom ash chute. The feeder includes a feed hopper adapted to feed fuel, such as all sorts of unsorted solid waste possibly in combination with biomass or biomass alone, to the inclined grate lanes 2, 3, 4, 5.

Figure 3:
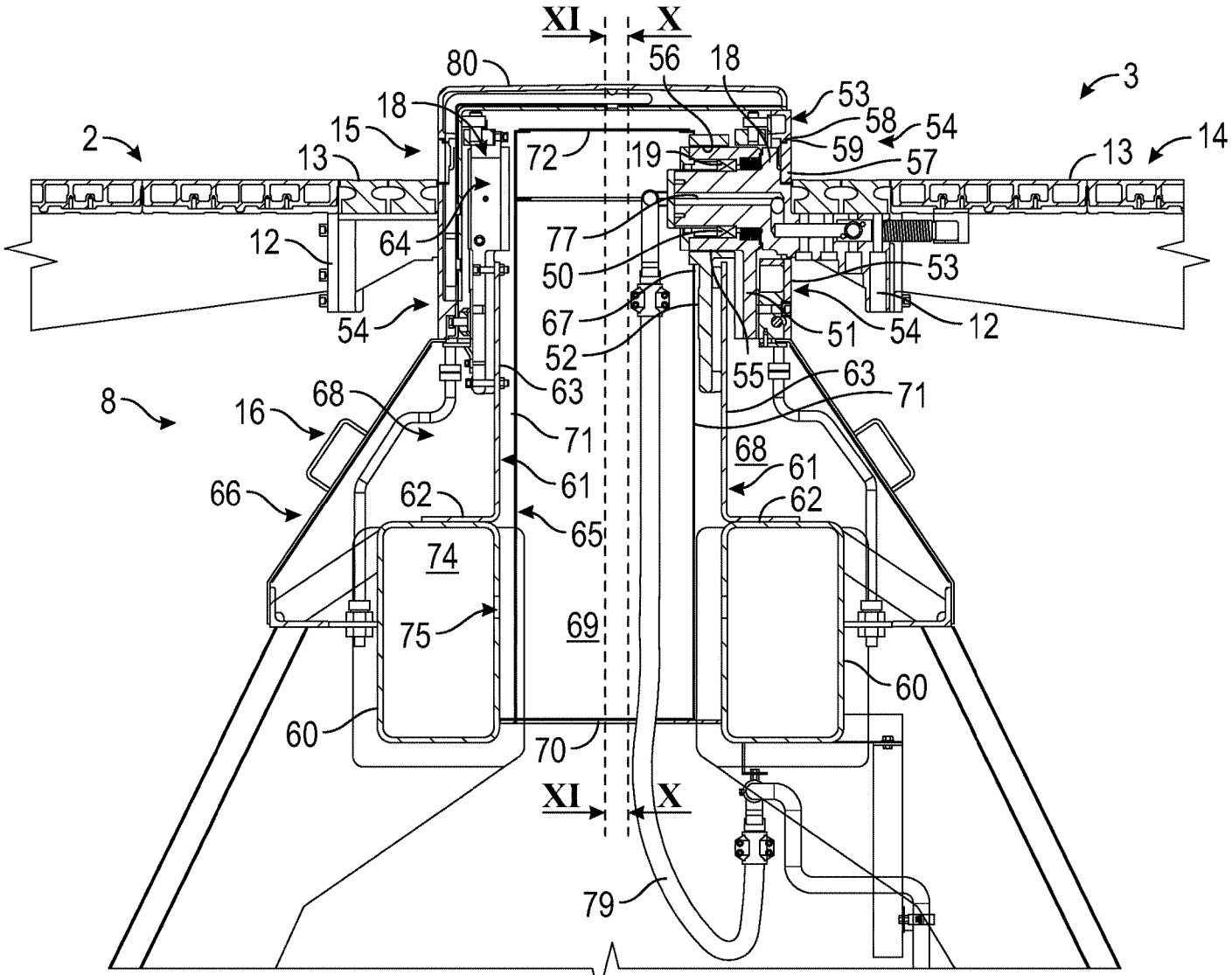
FIG. 3 illustrates a first midsection of the movable grate of FIG. 1 on a larger scale.
Figure 4:
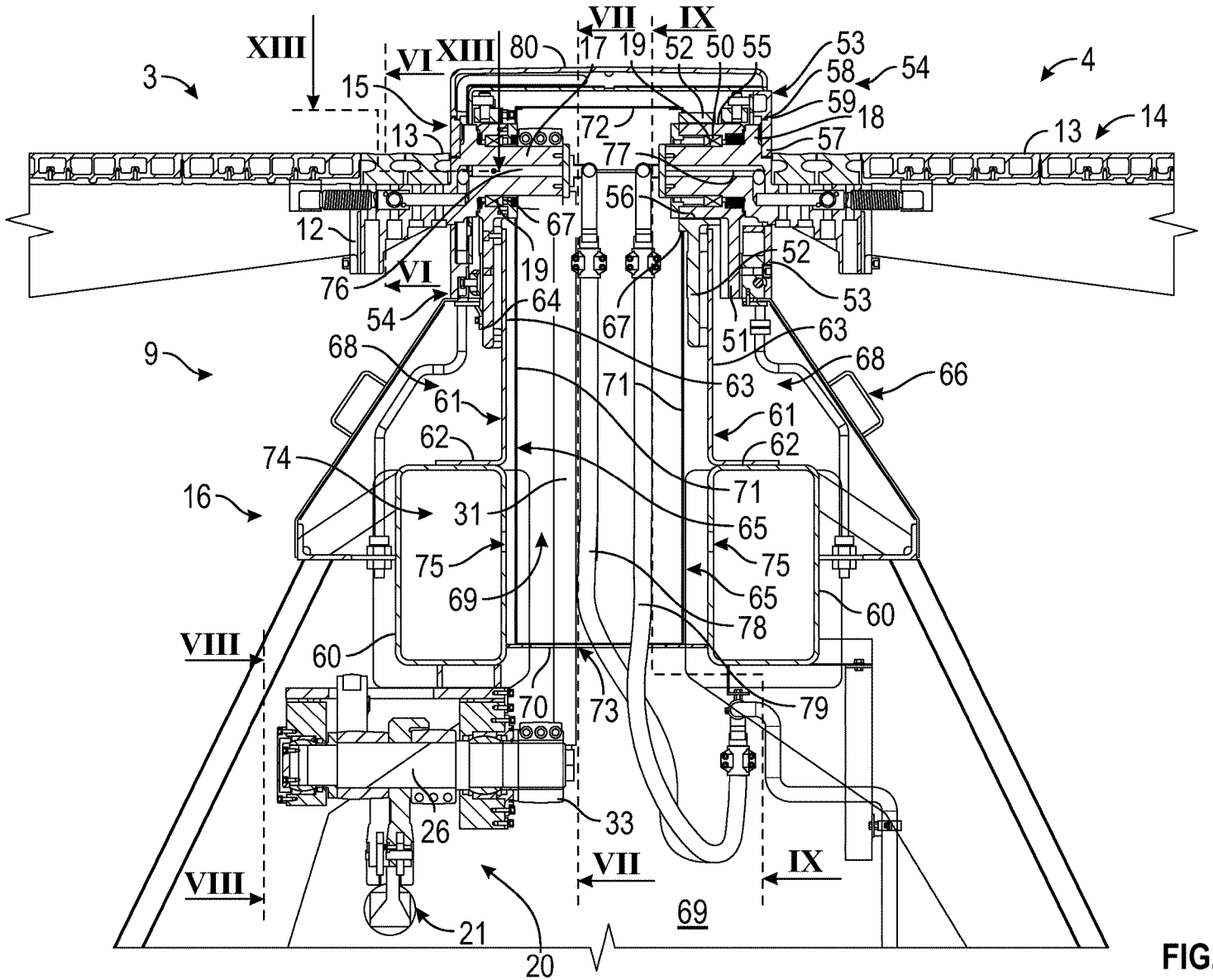
FIG. 4 illustrates a second midsection of the movable grate of FIG. 1 on a larger scale.
Figure 5:
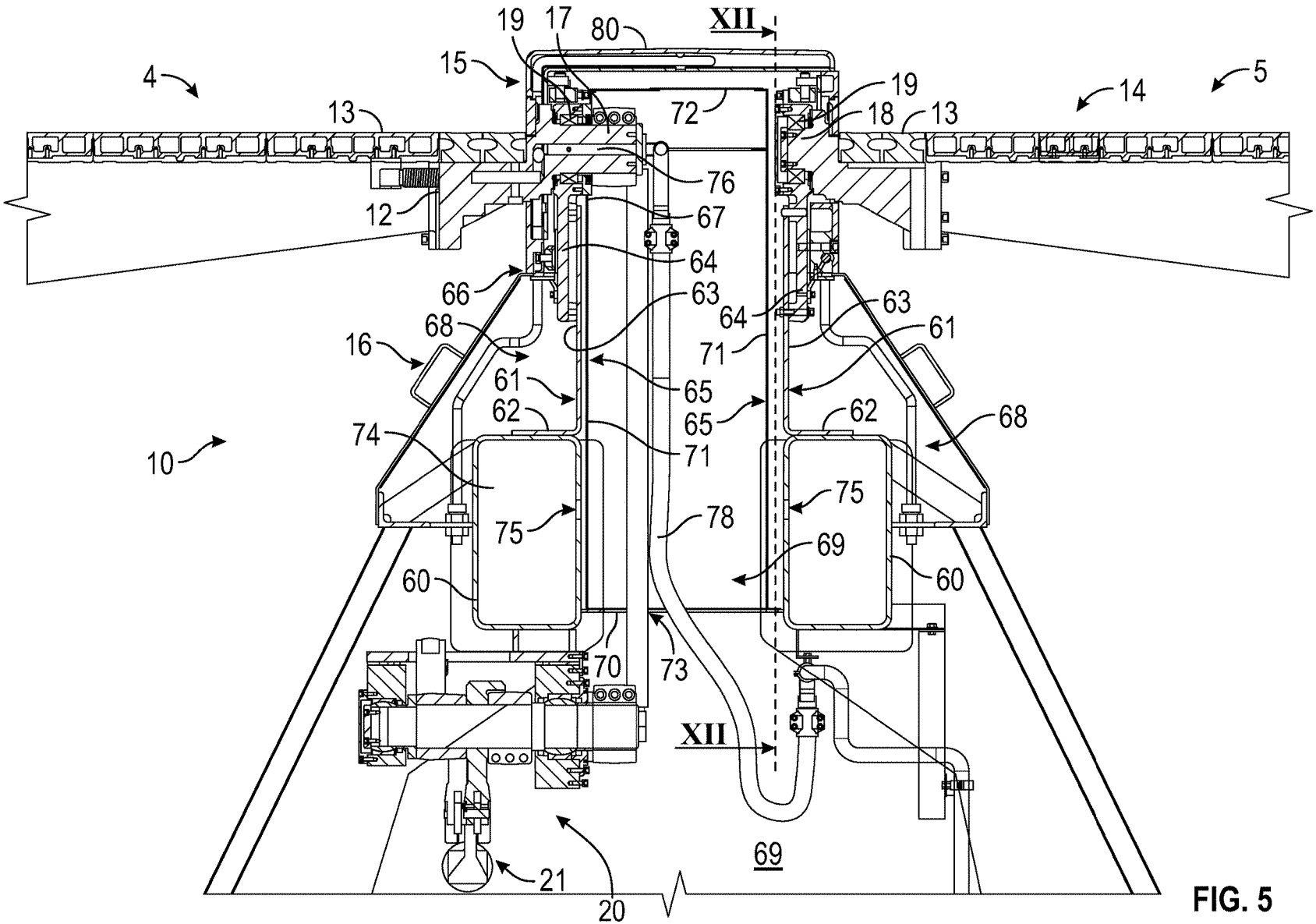
FIG. 5 illustrates a third midsection of the movable grate of FIG. 1 on a larger scale.
Figure 6A:
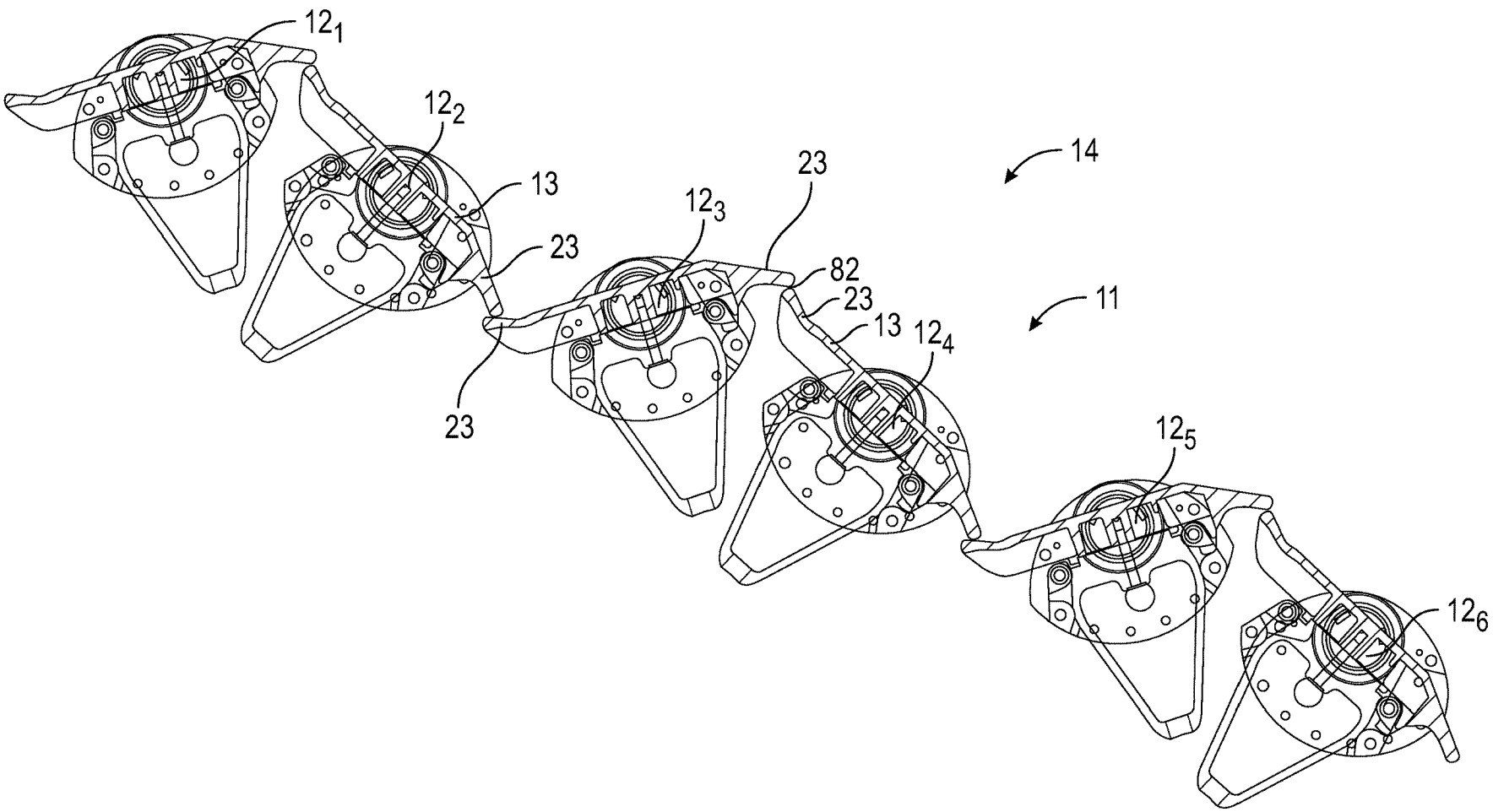
FIG. 6A illustrates the cross-section VI-VI indicated in FIG. 4 in one position of the grate shafts.
Figure 6B:
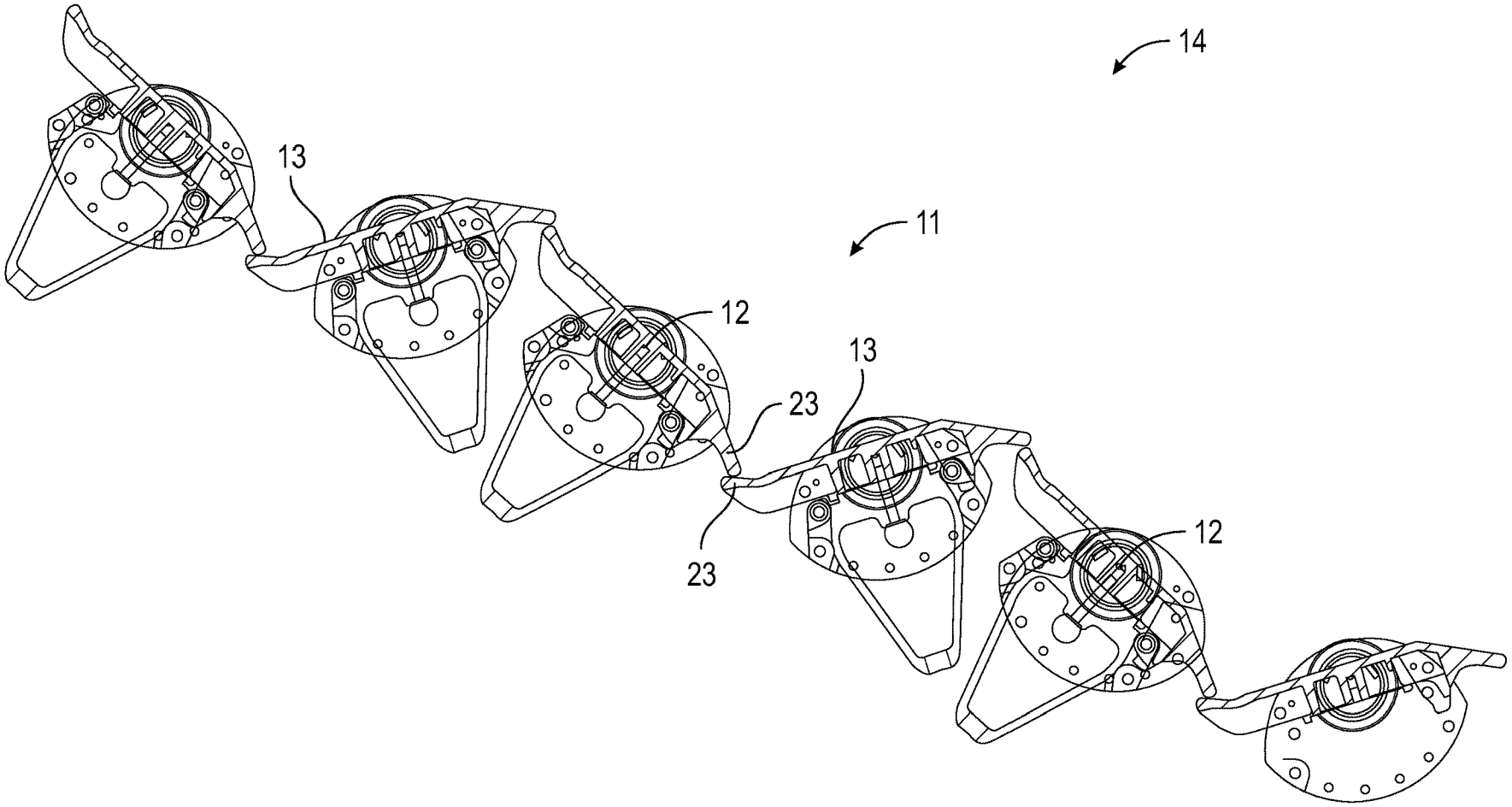
FIG. 6B illustrates the cross-section VI-VI indicated in FIG. 4 in a different position of the grate shafts than FIG. 6A.
Figure 7A:
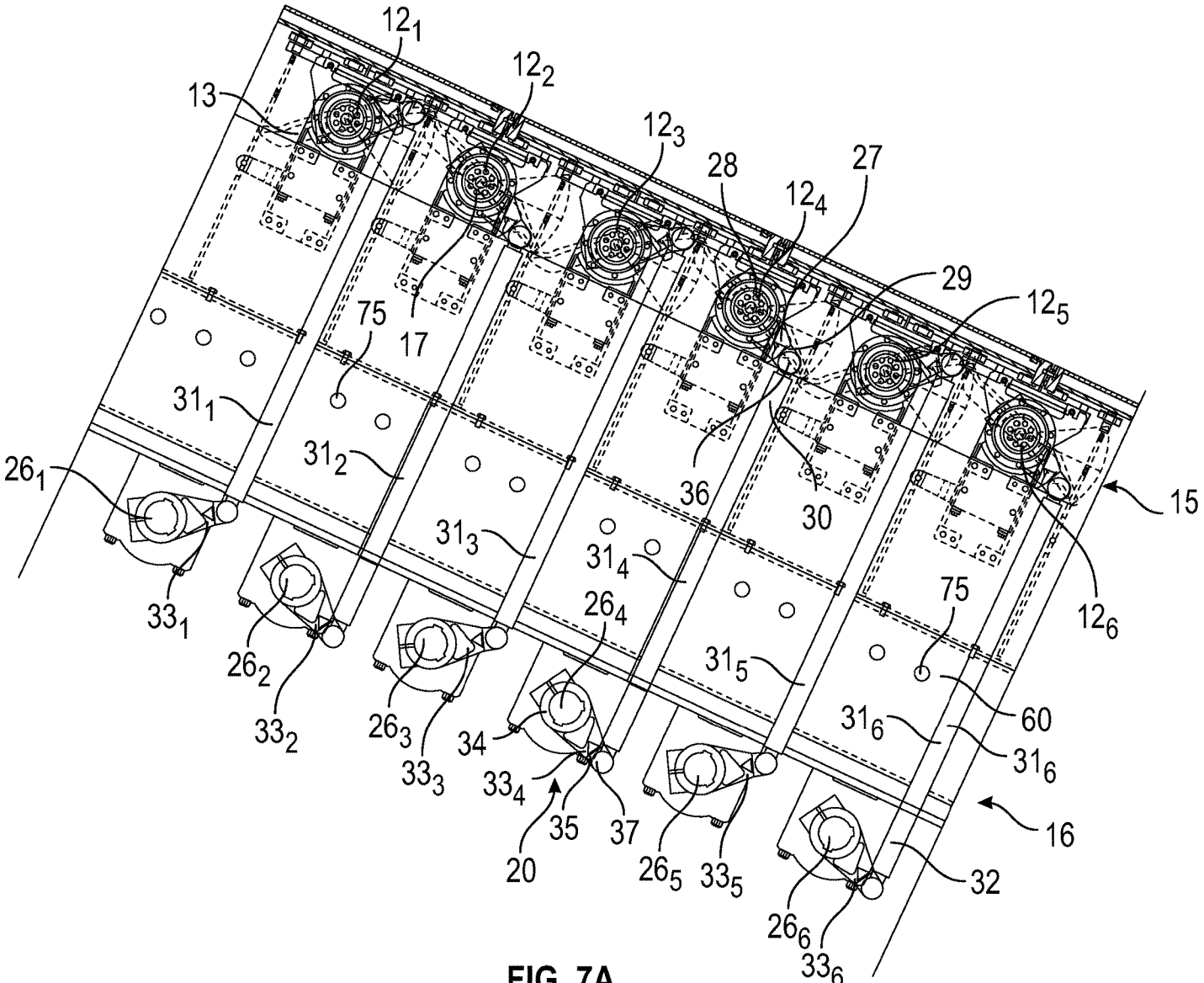
FIG. 7A illustrates the cross-section VII-VII indicated in FIG. 4 in the position of the grate shafts illustrated in FIG. 6A.
Figure 7B:
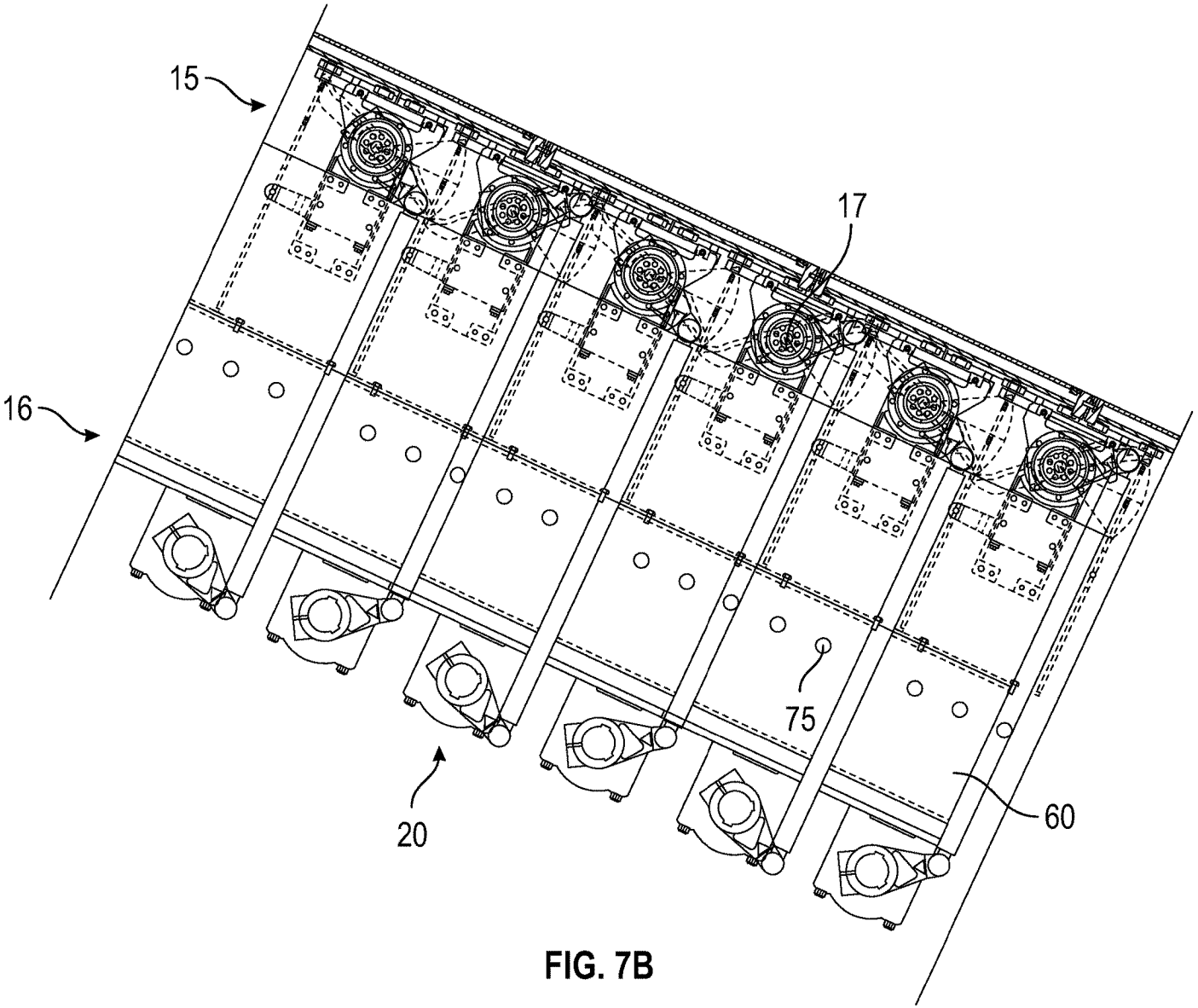
FIG. 7B illustrates the cross-section VII-VII indicated in FIG. 4 in the position of the grate shafts illustrated in FIG. 6B.

As seen in FIGS. 3, 4 and 5, each midsection 8, 9, 10 includes an upper relatively narrow housing section 15 arranged between grate bars 13 of the corresponding neighbouring grate lanes 2, 3, 4, 5 and a lower relatively broad housing section 16 protruding under grate bars 13 of said corresponding neighbouring grate lanes 2, 3, 4, 5. As seen, the upper relatively narrow housing section 15 has vertically extending side walls 54, and in the illustrated embodiment, the lower relatively broad housing section 16 has obliquely extending side walls extending downwards from the lower end of the vertically extending side walls 54 of the upper relatively narrow housing section 15. In the illustrated embodiment, the width of the bottom of the lower relatively broad housing section 16 is approximately 3 times the width of the upper relatively narrow housing section 15. This relation may be different, and it may for instance be between 2 and 4. Furthermore, the side walls of the lower relatively broad housing section 16 need not extend obliquely or entirely obliquely, but may for instance have vertically extending sections.

Figure 8A:
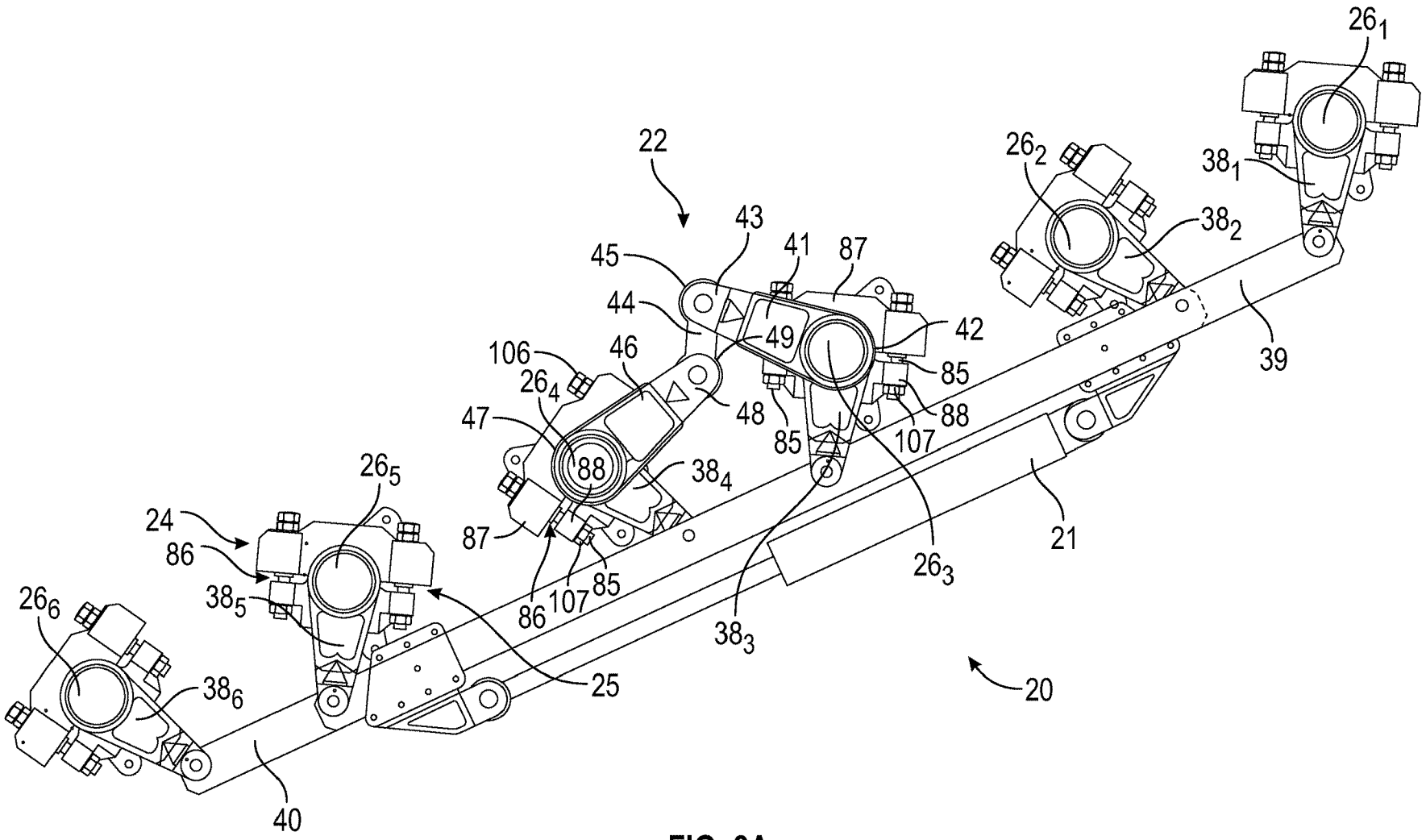
FIG. 8A illustrates the cross-section VIII-VIII indicated in FIG. 4 in the position of the grate shafts illustrated in FIG. 6A.
Figure 8B:
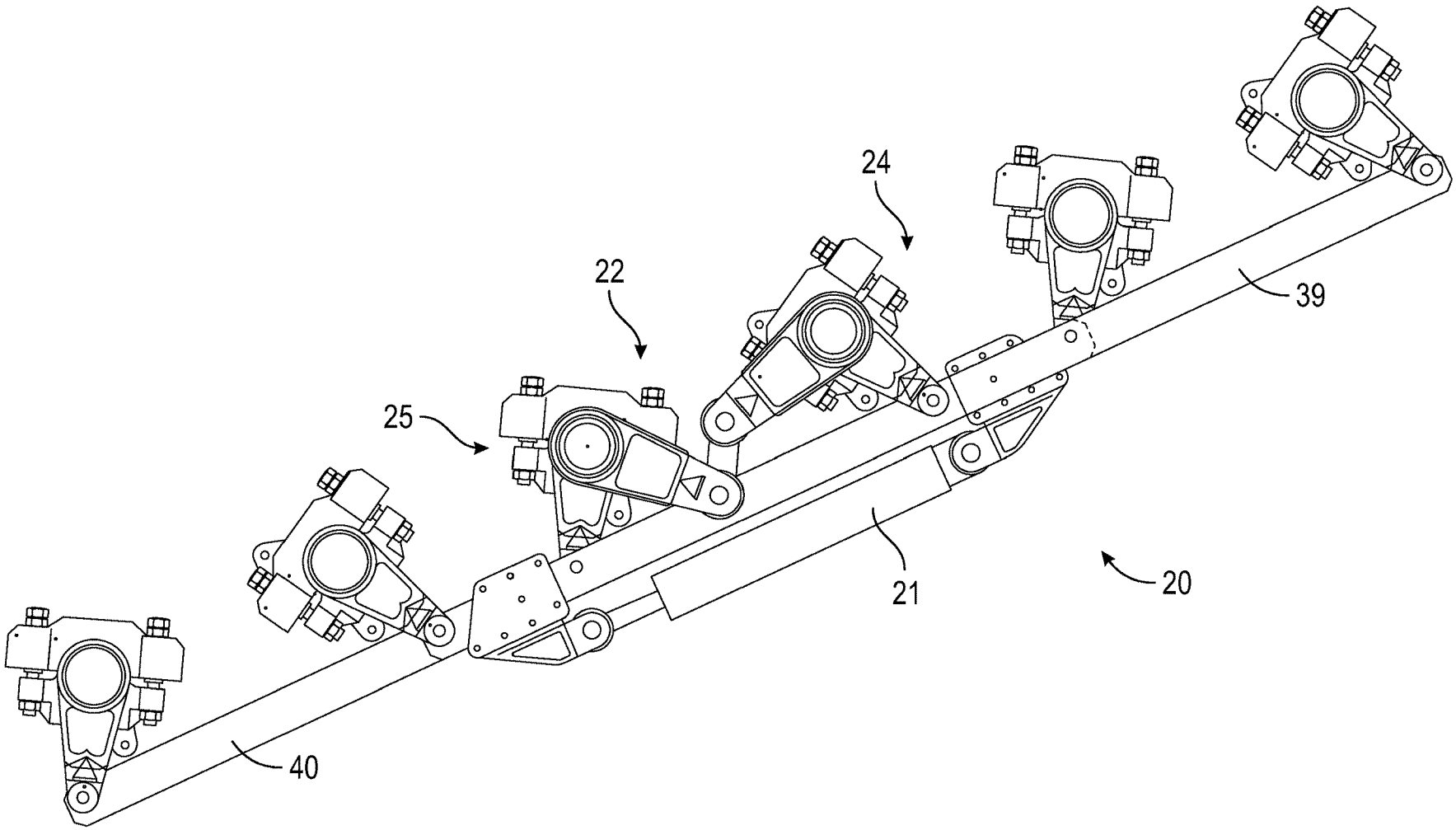
FIG. 8B illustrates the cross-section VIII-VIII indicated in FIG. 4 in the position of the grate shafts illustrated in FIG. 6B.
Figure 9A:
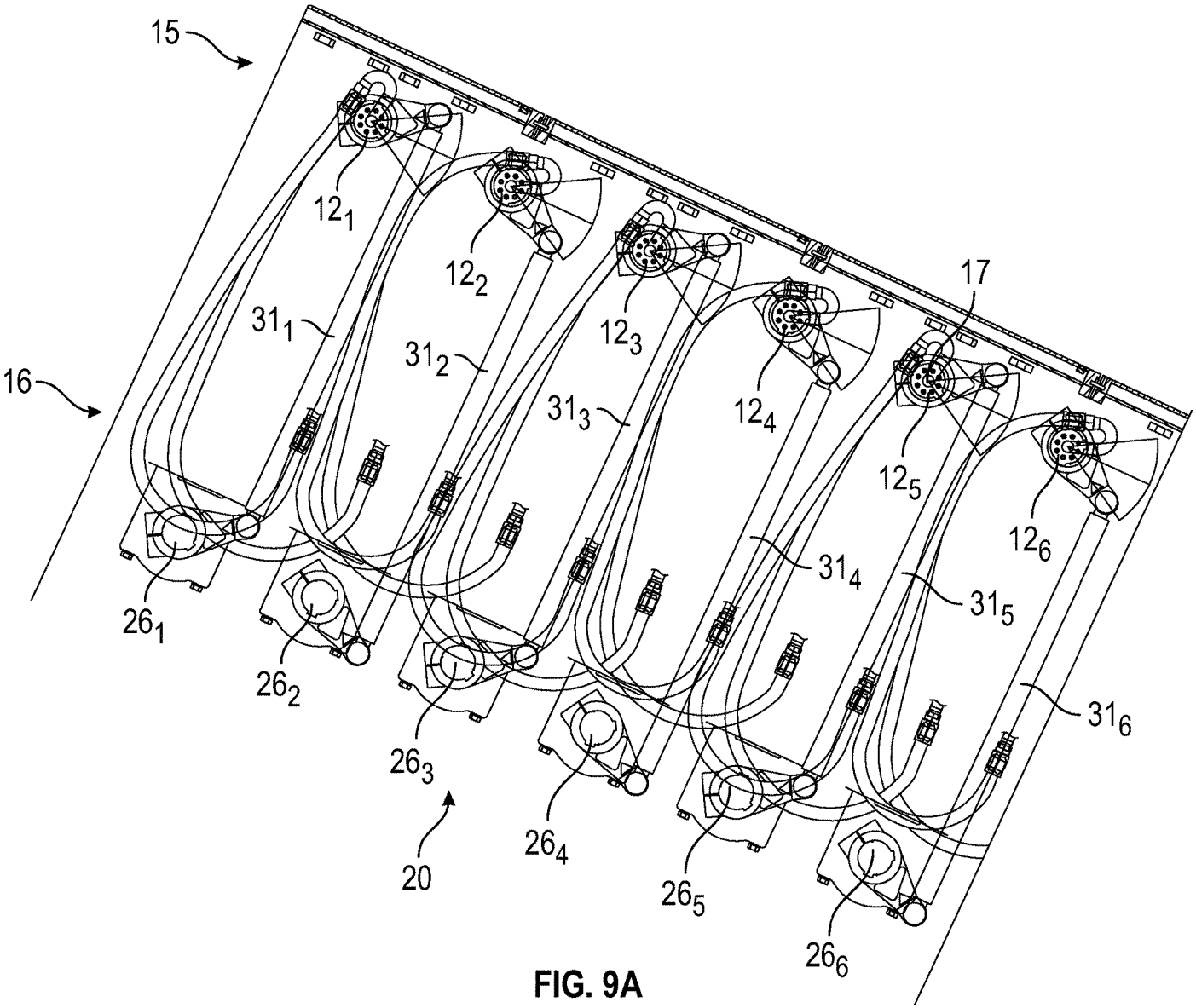
FIG. 9A illustrates the cross-section IX-IX indicated in FIG. 4 in the position of the grate shafts illustrated in FIG. 6A.
Figure 9B:
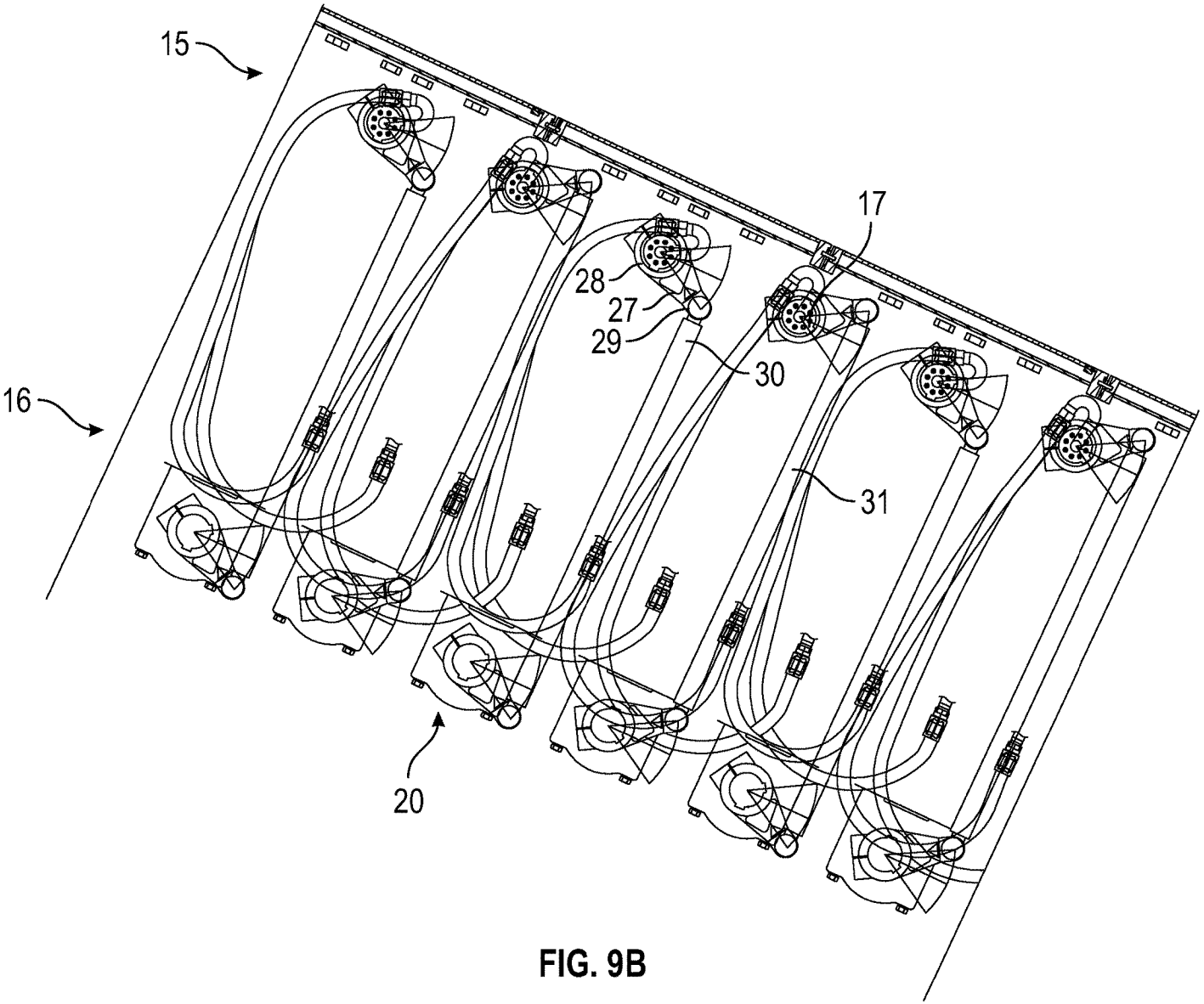
FIG. 9B illustrates the cross-section IX-IX indicated in FIG. 4 in the position of the grate shafts illustrated in FIG. 6B.
Figure 10:
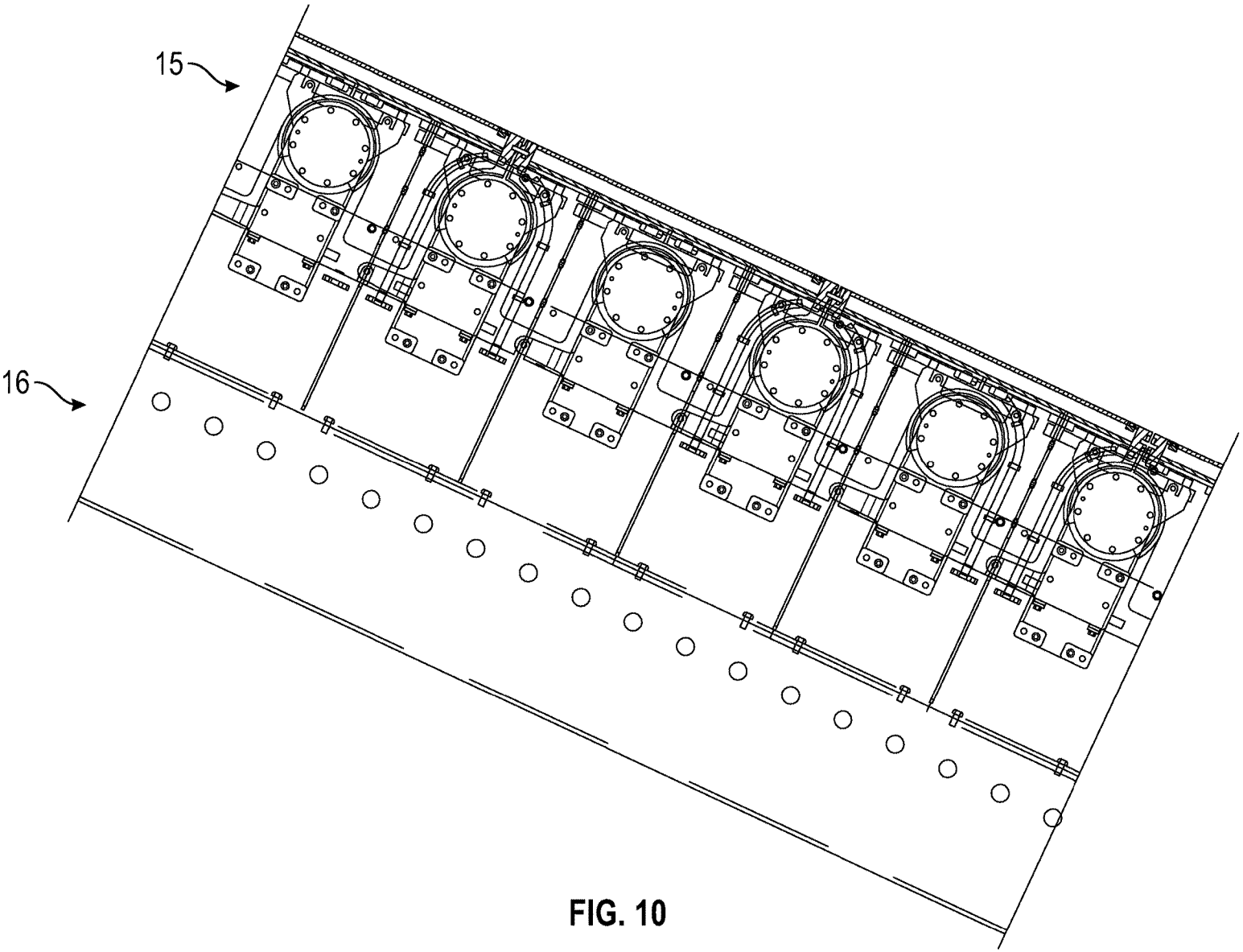
FIG. 10 illustrates the cross-section X-X indicated in FIG. 3.
Figure 11:
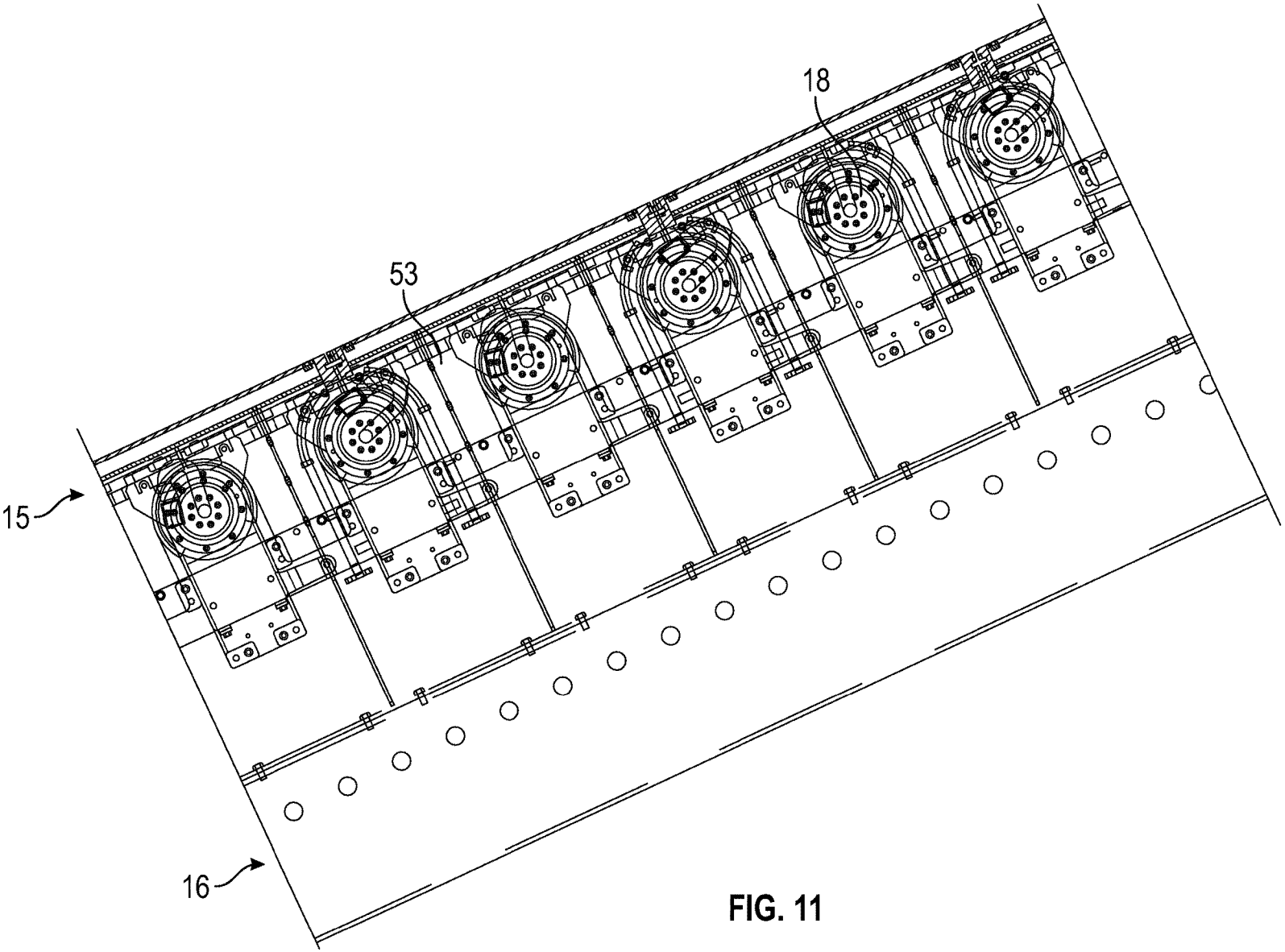
FIG. 11 illustrates the cross-section XI-XI indicated in FIG. 3.

Each grate shaft 12 has a driven grate shaft end 17 and a non-driven grate shaft end 18, and each grate shaft end 17, 18 is journalled in a respective bearing 19. As seen in FIG. 2, the left and right side sections 6, 7 enclose bearings 19 for corresponding driven grate shaft ends 17 of the left and right outermost grate lanes 2, 5, respectively. As seen in FIGS. 3, 4 and 5, the upper relatively narrow housing section 15 of each midsection 8, 9, 10 encloses bearings 19 for corresponding grate shaft ends 17, 18 of corresponding neighbouring grate lanes 2, 3, 4, 5. Furthermore, as seen in FIGS. 2, 4 and 5, each lane section 11 is provided with a drive mechanism 20 including an actuator 21 for pivoting back and forth neighbouring grate shafts 12 in opposite rotational directions so as to impart a wave-like movement to material, such as waste, on the grate surface 14 in order to transport such material in downwards direction. It is noted that the drive mechanism 20 is only partly illustrated for the left and right side sections 6, 7 in FIG. 1 and for the left side section 6 in FIG. 2. As illustrated in FIGS. 8A and 8B, a synchronising mechanism 22 is arranged to maintain a predetermined clearance 82 (so small that it is not distinguishable in the figures) between edge portions 23 of grate bars 13 of neighbouring grate shafts 12.

The grate bars 13 on each grate shaft 12 coincide with the grate bars 13 on the neighbouring shaft 12 without touching these, thereby forming the practically cohesive inclined grate surface 14. The gap between two coinciding grate bars 13 in the form of the predetermined clearance 82 mentioned just above may for instance be approximately 1 to 3 millimetres. The grate function is such that the grate shafts 12 alternately turn to their respective outer positions, and the inclined grate surface 14 thus forms a stair-shaped surface where the steps change direction. This produces a rolling movement to material present on the grate, which may have the effect of breaking it up and agitating it, while at the same time moving it forward in downward direction, thus achieving good exposure to radiant heat from the combustion chamber 83 and good exposure to combustion air.

Figure 2:
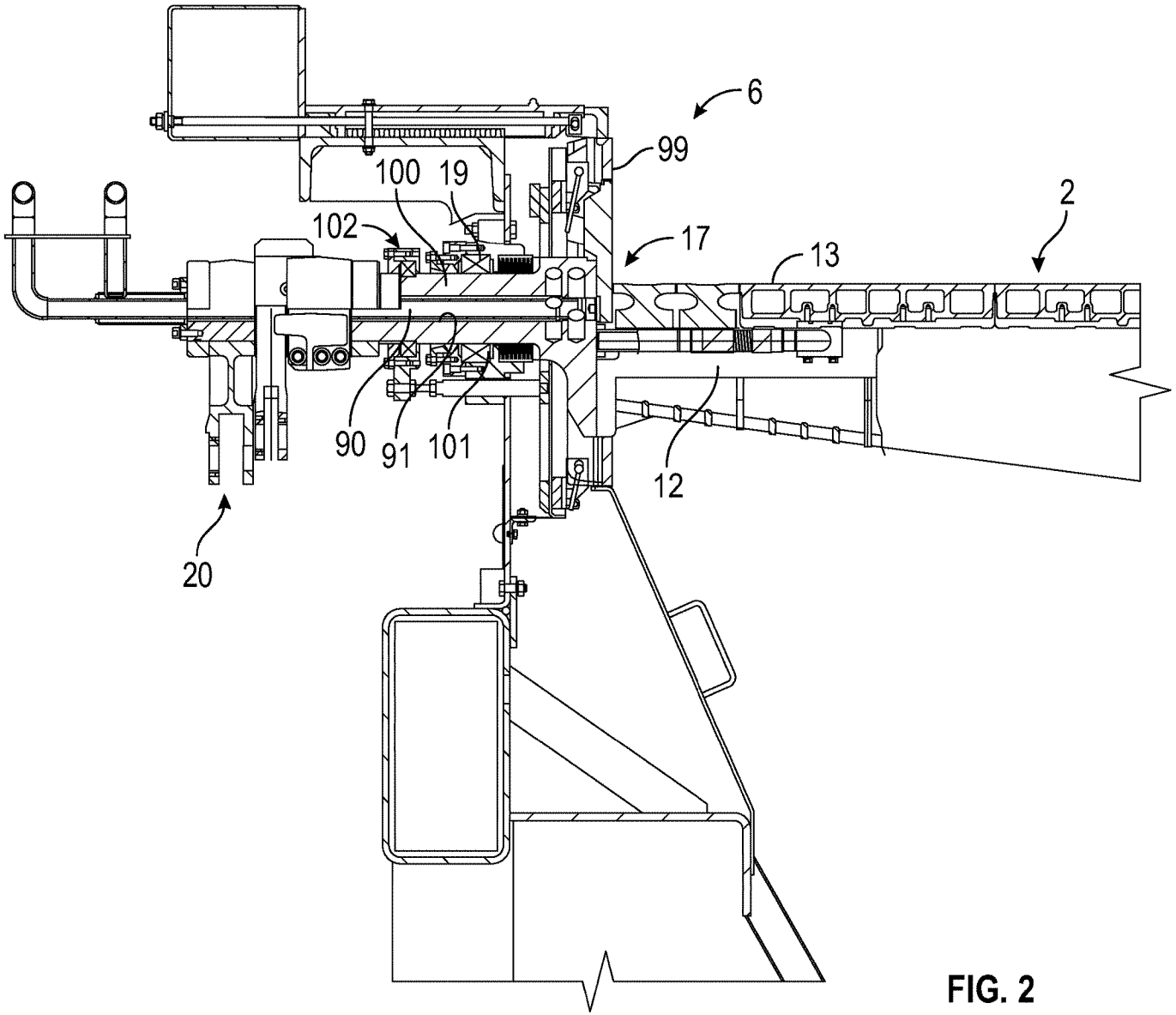
FIG. 2 illustrates a left side section of the movable grate of FIG. 1 on a larger scale.

In the embodiment of the invention illustrated in FIG. 1, and as seen in FIGS. 4, 5 and 8, the second midsection 9 and the third midsection 10 include the drive mechanism 20 and the synchronising mechanism 22 of corresponding lane sections 11, and the actuator 21 of said drive mechanism 20 and said synchronising mechanism 22 are located in the lower relatively broad housing section 16 of said second and third midsections 9, 10. Thereby, by locating the actuator 21 of said drive mechanism 20 and said synchronising mechanism 22 in the lower relatively broad housing section 16, it is possible to incorporate a drive mechanism in the midsection while maintaining a relatively narrow upper midsection and also providing good access to drive mechanism and synchronising mechanism during service and maintenance.

Furthermore, as illustrated in FIGS. 8A and 8B, in the second midsection 9 and the third midsection 10 including the drive mechanism 20 and the synchronising mechanism 22 of corresponding lane sections 11, the mutual relative pivotal positions of the respective grate shafts $\mathbf{12}_1$, $\mathbf{12}_2$, $\mathbf{12}_3$, $\mathbf{12}_4$, $\mathbf{12}_5$, $\mathbf{12}_6$ of each lane section are individually adjustable by means of respective clearance adjustment mechanisms 24 located in the lower relatively broad housing section 16 of said midsections 9, 10. By locating the respective clearance adjustment mechanisms 24 in the lower relatively broad housing section 16, the clearance adjustment mechanisms may be easily accessible, thereby facilitating service and maintenance.

Furthermore, as illustrated in FIGS. 8A and 8B, in the second midsection 9 and the third midsection 10 including the drive mechanism 20 and the synchronising mechanism 22 of corresponding lane sections 11, the mutual relative pivotal positions of the respective grate shafts $\mathbf{12}_1$, $\mathbf{12}_2$, $\mathbf{12}_3$, $\mathbf{12}_4$, $\mathbf{12}_5$, $\mathbf{12}_6$ of each lane section are individually elastically biased towards respective predetermined relative pivotal positions by means of respective biasing mechanisms 25 located in the lower relatively broad housing section 16 of said midsections 9, 10. Thereby, if the movement of a grate shaft is prevented, the movement may wholly or partly be taken up by the biasing mechanisms 25. Furthermore, by locating the respective biasing mechanisms 25 in the lower relatively broad housing section 16, the biasing mechanisms may be easily accessible, thereby facilitating service and maintenance. Said predetermined relative pivotal positions may be set by means of the above-described clearance adjustment mechanisms 24.

Referring to FIGS. 4, 5, 7 and 9, in the second midsection 9 and the third midsection 10 including the drive mechanism 20 and the synchronising mechanism 22 of corresponding lane sections 11, a number of drive shafts $\mathbf{26}_1$, $\mathbf{26}_2$, $\mathbf{26}_3$, $\mathbf{26}_4$, $\mathbf{26}_5$, $\mathbf{26}_6$ corresponding to the respective grate shafts $\mathbf{12}_1$, $\mathbf{12}_2$, $\mathbf{12}_3$, $\mathbf{12}_4$, $\mathbf{12}_5$, $\mathbf{12}_6$ of the at least one lane section are located in the lower relatively broad housing section 16 of said at least one midsection 9, 10, and the driven grate shaft end 17 of each said grate shaft $\mathbf{12}_1$, $\mathbf{12}_2$, $\mathbf{12}_3$, $\mathbf{12}_4$, $\mathbf{12}_5$, $\mathbf{12}_6$ is individually in driven connection with a corresponding one of said drive shafts $\mathbf{26}_1$, $\mathbf{26}_2$, $\mathbf{26}_3$, $\mathbf{26}_4$, $\mathbf{26}_5$, $\mathbf{26}_6$. Thereby, by driving each grate shaft independently by means of a respective drive shaft located in the lower relatively broad housing section of the midsection, the movement of each grate shaft may be controlled independently from an easily accessible location, thereby facilitating precise control and adjustment of the movement of each separate grate shaft in connection with service and maintenance.

In principle, said driven connection could be any suitable means of drive transmission; however, in the illustrated embodiment, the driven grate shaft end 17 of each respective shaft $\mathbf{12}_1$, $\mathbf{12}_2$, $\mathbf{12}_3$, $\mathbf{12}_4$, $\mathbf{12}_5$, $\mathbf{12}_6$ is provided with a grate shaft lever arm 27, a first end 28 of the grate shaft lever arm 27 is in driving connection with the grate shaft 12 and a second end 29 of the grate shaft lever arm 27 is pivotally connected to a first end 30 of a corresponding connection rod 31. In the illustrated embodiment, the first end 28 of the grate shaft lever arm 27 is fixedly mounted on the driven grate shaft end 17 of the grate shaft 12 by means of bolts. Each said drive shaft $\mathbf{26}_1$, $\mathbf{26}_2$, $\mathbf{26}_3$, $\mathbf{26}_4$, $\mathbf{26}_5$, $\mathbf{26}_6$ is provided with a drive shaft lever arm 33, and a first end 34 of the drive shaft lever arm 33 is in driven connection with the drive shaft and a second end 35 of the drive shaft lever arm 33 is pivotally connected to a second end 32 of the corresponding connection rod 31. In the illustrated embodiment, the first end 34 of the drive shaft lever arm 33 is fixedly mounted on the drive shaft by means of bolts. Thereby, each grate shaft lever arm 27 is connected with a corresponding drive shaft lever arm 33 by means of a corresponding connection rod 31. Thereby, by driving each grate shaft by means of a connection rod, a precise transmission of the movement from the actuator to the grate shaft is possible. Furthermore, by driving each grate shaft independently by means of a respective connection rod extending down into the lower relatively broad housing section of the midsection, the movement of each grate shaft may be controlled independently from an easily accessible location, thereby facilitating precise control and adjustment of the movement of each separate grate shaft in connection with service and maintenance.

In the illustrated embodiment, each connection rod 31 is pivotally connected to the corresponding grate shaft lever arm 27 by means of a first ball joint 36, and each connection rod 31 is pivotally connected to the corresponding drive shaft lever arm 33 by means of a second ball joint 37. Thereby, a more flexible connection between the grate shaft lever arm and the corresponding drive shaft lever arm may be achieved. Furthermore, it may be possible to employ standard ball joints which are fully sealed and do not require any service for an extended period of time. Such standard ball joints are for instance used in the suspension and steering of cars. The use of such ball joints may be advantageous, especially in relation to ball joints located in the upper relatively narrow housing section where accessibility may be restricted. Furthermore, a ball joint may be better suitable for rocking motion back and forth as compared to standard ball bearings and may therefore last longer. If standard ball bearings are employed, these have to be provided with shaft seals. The shaft seals may not be very well suitable for the rocking motion back and forth and may therefore leak after extended use. Furthermore, the shaft seals may increase the size of the pivotal joint between the connection rod 31 and the corresponding drive shaft lever arm 33 or the corresponding grate shaft lever arm 27. This may be a disadvantage, because space may be limited in the upper relatively narrow housing section 15 of the respective midsections 9, 10.

Referring now to FIGS. 6 to 9, the grate shafts $\mathbf{12}_1$, $\mathbf{12}_2$, $\mathbf{12}_3$, $\mathbf{12}_4$, $\mathbf{12}_5$, $\mathbf{12}_6$ of each lane section 11 are numbered consecutively in downward direction, and the corresponding drive shafts $\mathbf{26}_1$, $\mathbf{26}_2$, $\mathbf{26}_3$, $\mathbf{26}_4$, $\mathbf{26}_5$, $\mathbf{26}_6$ are numbered correspondingly. Each drive shaft is provided with a crank arm $\mathbf{38}_1$, $\mathbf{38}_2$, $\mathbf{38}_3$, $\mathbf{38}_4$, $\mathbf{38}_5$, $\mathbf{38}_6$, the crank arms $\mathbf{38}_1$, $\mathbf{38}_3$, $\mathbf{38}_5$ of drive shafts $\mathbf{26}_1$, $\mathbf{26}_3$, $\mathbf{26}_5$ having odd numbers are connected by means of a first linking rod 39, and the crank arms $\mathbf{38}_2$, $\mathbf{38}_4$, $\mathbf{38}_6$ of drive shafts $\mathbf{26}_2$, $\mathbf{26}_4$, $\mathbf{26}_6$ having even numbers are connected by means of a second linking rod 40. The actuator 21 of said drive mechanism 20 is a linear actuator, such as a hydraulic piston actuator, and the first linking rod 39 and the second linking rod 40 are interconnected by means of the linear actuator 21. Thereby, by operating said linear actuator back and forth, neighbouring grate shafts $\mathbf{12}_1$, $\mathbf{12}_2$, $\mathbf{12}_3$, $\mathbf{12}_4$, $\mathbf{12}_5$, $\mathbf{12}_6$ may be pivoted back and forth in opposite rotational directions so as to impart a wave-like movement to material on the grate surface 14 in order to transport such material downwards.

Figure 15:
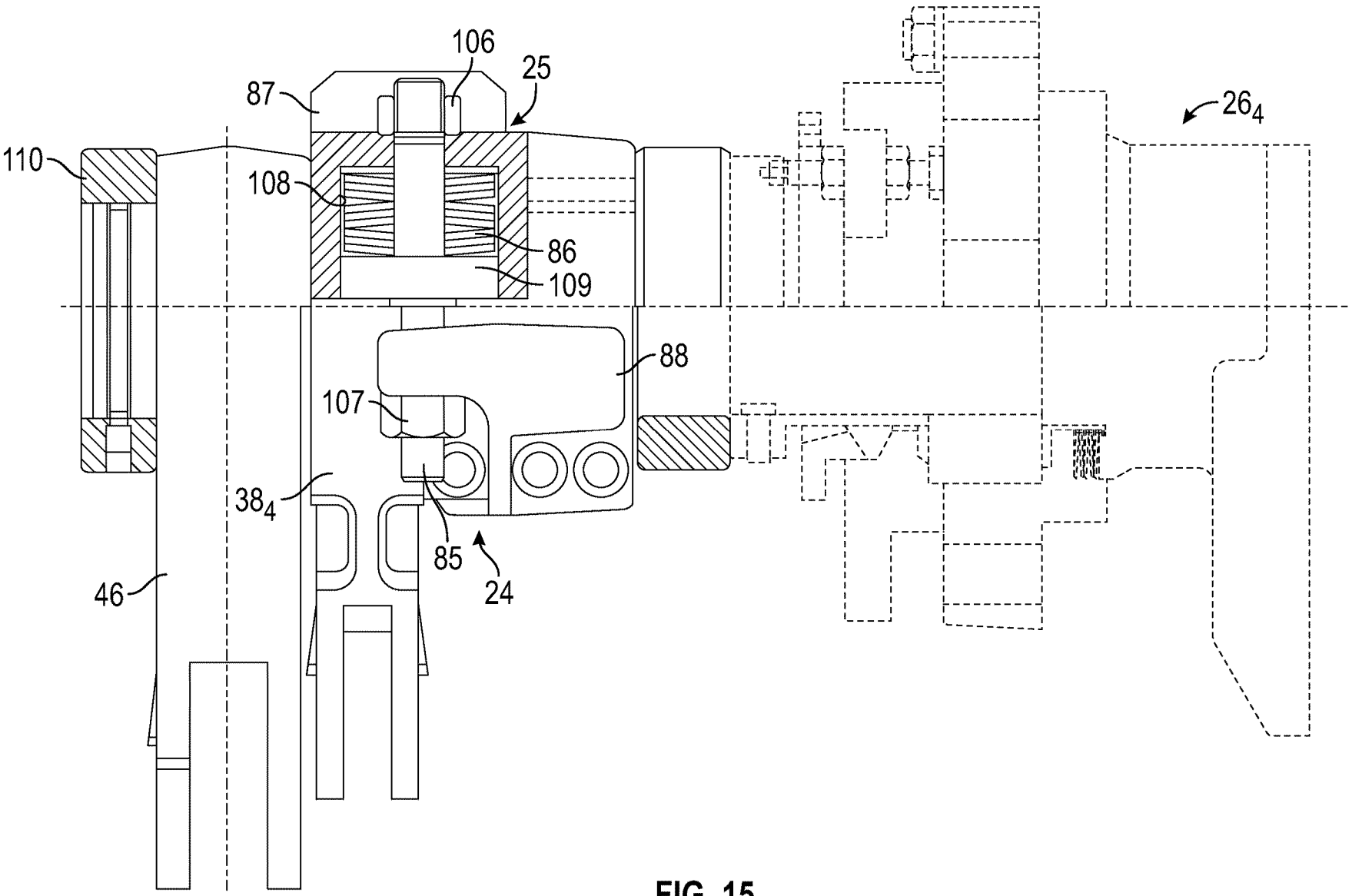
FIG. 15 illustrates a partial cross-sectional view through a clearance adjustment and biasing mechanism illustrated in FIG. 8.

A first end of each crank arm 38 is mounted pivotally adjustably on the corresponding drive shaft 26 and a second end of each crank arm 38 is connected pivotally to the corresponding first or second linking rod 39, 40 at a respective point thereof. Referring now to FIGS. 8 and 15, each drive shaft 26 is provided with a carrier 88 which extends transversely and is fixedly connected to said drive shaft 26 for instance by means of a key or spline connection. Furthermore, said drive shaft 26 is inserted pivotally into a bore in the first end of a corresponding crank arm 38. Said crank arm 38 is rigidly connected to or formed in one piece with a transverse upper part 87 which is adjustably connected to the carrier 88 by means of two set screws 85. A stack of disc springs 86 is arranged on a disc spring guide 109 in a bore 108 in each respective end of the transverse upper part 87 of said crank arm 38. The disc spring guide 109 has a head fitting the bore 108 and located below the stack of disc springs 86 in the bore 108 and a threaded spindle part extending up through the bore 108 and secured on top of the respective end of the transverse upper part 87 of said crank arm 38 by means of a nut 106. By tightening the nut 106, the stack of disc springs 86 may be preloaded. An upper end of each set screw 85 normally abuts the lower side of the head of the respective disc spring guide 109. A lower end of each set screw 85 is threaded into a respective end of the transversely extending carrier 88 and is secured by means of a locking nut 107.

By means of the above-described arrangement of the crank arms 38 on the respective drive shafts 26, the relative rotational position of each crank arm 38 in relation to the corresponding drive shaft 26 may be adjusted by rotation of the two corresponding set screws 85. The adjusted position may be fixed by tightening the locking nuts 107 on the respective set screws 85. Thereby, the adjustment of the driven connection may be performed in the lower relatively broad housing section, thereby facilitating adjustment of the individual clearance 82 between edge portions 23 of grate bars 13 in connection with service and maintenance.

Furthermore, by means of the stack of disc springs 86, each crank arm 38 is mounted on the corresponding drive shaft 26 elastically biased towards a predetermined relative pivotal position in relation to said drive shaft 26. Thereby, if the movement of a grate shaft is prevented, the movement may wholly or partly be taken up by the elastic biasing mechanisms in that one or more of the stacks of disc springs 86 is compressed between the guide 109 for disc springs and the top of the bore 108 in a respective end of the transverse upper part 87 of a crank arm 38. This may happen as an upper end of a respective set screw 85 presses on a respective head of a disc spring guide 109. Thereby, the upper ends of respective set screws 85 arranged at an end of a transverse upper part 87 opposed to an end pressing on a head may possibly be lowered or released from abutment with the respective head of a disc spring guide 109. By locating the respective elastic biasing mechanisms in the lower relatively broad housing section, the biasing mechanisms may be easily accessible, thereby facilitating service and maintenance.

It is noted that FIG. 15 illustrates only part of the drive mechanism relating to the clearance adjustment and biasing mechanism, as some parts have been left out in this figure.

Furthermore, it is seen in FIG. 8 that one $\mathbf{26}_3$ of the drive shafts $\mathbf{26}_1$, $\mathbf{26}_3$, $\mathbf{26}_5$ having odd numbers is connected to one $\mathbf{26}_4$ of the drive shafts $\mathbf{26}_2$, $\mathbf{26}_4$, $\mathbf{26}_6$ having even numbers by means of the synchronising mechanism 22 of at the least one lane section 11. The synchronising mechanism 22 includes a first synchronising lever arm 41 having a first end 42 fixedly connected to said one $\mathbf{26}_3$ of the drive shafts $\mathbf{26}_1$, $\mathbf{26}_3$, $\mathbf{26}_5$ having odd numbers and a second end 43 pivotally connected to a first end 45 of a synchronising rod 44 and a second synchronising lever arm 46 having a first end 47 fixedly connected to said one $\mathbf{26}_4$ of the drive shafts $\mathbf{26}_2$, $\mathbf{26}_4$, $\mathbf{26}_6$ having even numbers and a second end 48 pivotally connected to a second end 49 of the synchronising rod 44. Thereby, the synchronising mechanism 22 may maintain a predetermined clearance between edge portions 23 of grate bars 13 of neighbouring grate shafts 12.

In the illustrated embodiment, as explained above, each said drive shaft $\mathbf{26}_1$, $\mathbf{26}_2$, $\mathbf{26}_3$, $\mathbf{26}_4$, $\mathbf{26}_5$, $\mathbf{26}_6$ is provided with a drive shaft lever arm 33, and a first end 34 of the drive shaft lever arm 33 is in driven connection with the drive shaft and a second end 35 of the drive shaft lever arm 33 is pivotally connected to a second end 32 of the corresponding connection rod 31. However, in alternative embodiments, each connection rod 31 extending down into the lower relatively broad housing section 16 of a midsection 9, 10 is with its second end 32 located in said relatively broad housing section 16 in driven connection with the actuator 21 of said drive mechanism 20 by other means than illustrated. For instance, the second end 32 of connection rods 31 corresponding to grate shafts 12 having odd numbers may be connected by means of a first connection rod, and the second end 32 of connection rods 31 corresponding to grate shafts 12 having equal numbers may be connected by means of a second connection rod. The first and second connection rods may be connected by means of an actuator, such as a linear actuator or linear actuators or a rotary actuator or rotary actuators provided with two crank arms connected to the respective first and second connection rods. Appropriate synchronizing means may further be provided.

In these alternative embodiments, the driven connection between the second end 32 of said respective connection rods 31 and the actuator 21 of said drive mechanism 20 may be individually adjustable in order to adjust the individual predetermined clearance between edge portions 23 of grate bars 13 of neighbouring grate shafts 12. Thereby, the adjustment of the driven connection may be performed in the lower relatively broad housing section, thereby facilitating adjustment of clearance in connection with service and maintenance. Furthermore, in these alternative embodiments, the driven connection between the second end 32 of said respective connection rods 31 and the actuator 21 of said drive mechanism 20 may be individually elastically biased towards respective predetermined relative positions by means of respective biasing mechanisms located in the lower relatively broad housing section 16 of said midsections 9, 10. Thereby, if the movement of a grate shaft is prevented, the movement may wholly or partly be taken up by the biasing mechanisms. Furthermore, by locating the respective biasing mechanisms in the lower relatively broad housing section 16, the biasing mechanisms may be easily accessible, thereby facilitating service and maintenance.

Figure 4A:
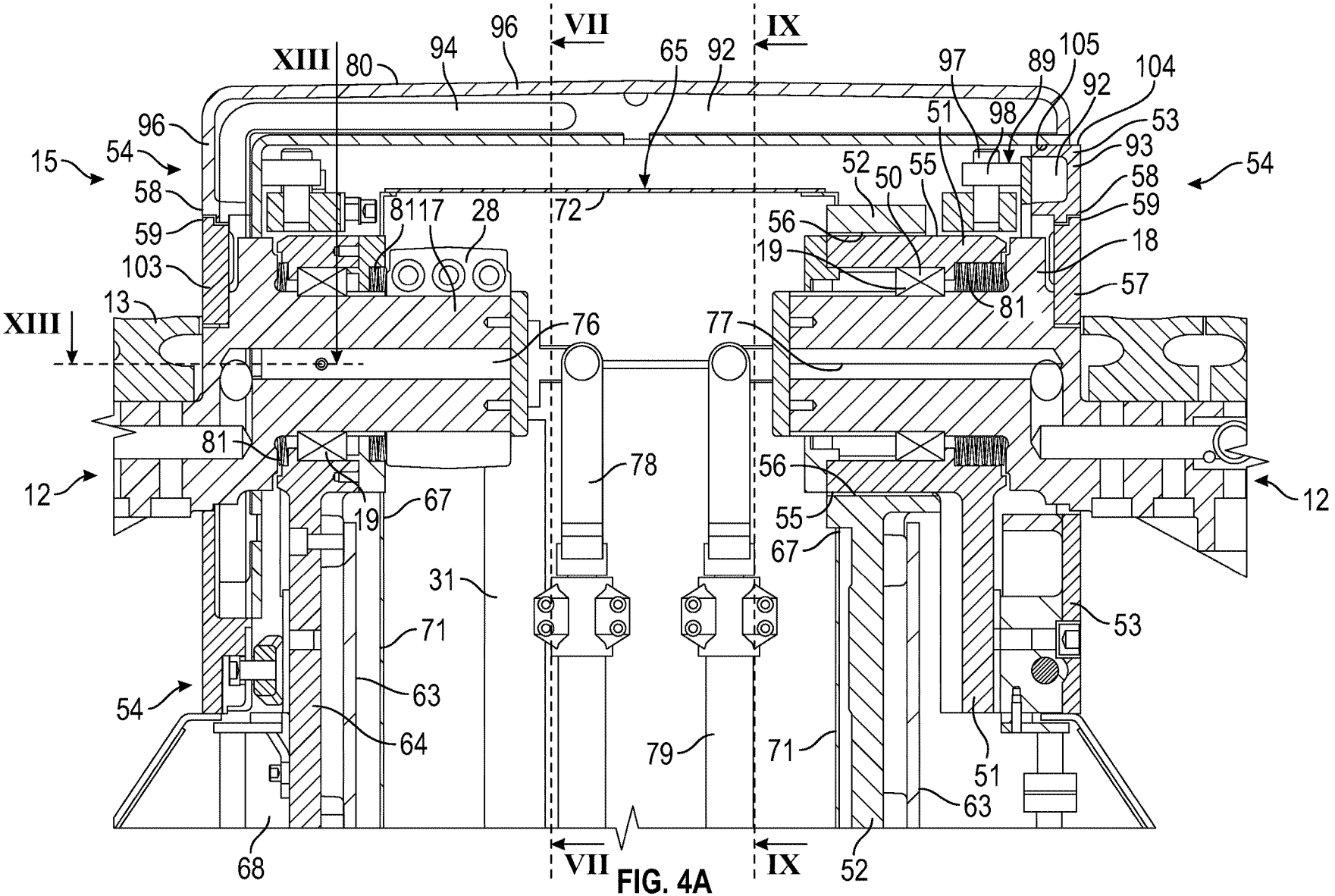
FIG. 4A illustrates the upper part of the second midsection of FIG. 4 on a larger scale.

Referring to FIGS. 3 and 4, and in particular FIG. 4A, it is seen that each of the first midsection 8 and the second midsection 9 includes an axially displaceable bearing 50 in which a corresponding non-driven grate shaft end 18 of each corresponding lane section 11 is journalled. Each said axially displaceable bearing 50 is mounted in a displaceable bearing house 51 mounted displaceably in relation to a stationary bearing house support 52 mounted in fixed relationship to the respective midsection 8, 9 so that said displaceable bearing house 51 is displaceable in the axial direction of the corresponding grate shaft 12. Said displaceable bearing house 51 is fixed against rotation about said axial direction by means of not shown means, such as a guide pin or the like. A non-pivotal side cover plate 53 is coupled to and axially displaceable with said displaceable bearing house 51 by means of coupling elements 89. In the illustrated embodiment, the coupling elements 89 include a number of vertical taps 97 fixed on said displaceable bearing house 51 and a number of hinge parts 98 fixed on the non-pivotal side cover plate 53 and each having a boring in which a corresponding vertical tap 97 is inserted so that the non-pivotal side cover plates 53 so to say hang on the corresponding displaceable bearing houses 51. This provides for easy assembly and disassembly. Many different configurations are possible. The non-pivotal side cover plate 53 forms part of the side wall 54 of the upper relatively narrow housing section 15 of the respective midsections 8, 9 including axially displaceable bearings 50, and the non-pivotal side cover plate 53 is mounted in proximity to the outermost grate bars 13 carried by the grate shafts 12 of the corresponding lane sections 11. Thereby, axial displacements of grate shaft ends resulting from temperature changes of the grate shafts 12 may be allowed for without changing the clearance between the non-pivotal side cover plate 53 and the outermost rocking grate bars 13, thereby ensuring better control of the supply of combustion air. Furthermore, by coupling the non-pivotal side cover plate 53 to the axially displaceable bearing house 51, a very slim midsection may be achieved even with displaceable non-pivotal side cover plates.

As seen in FIG. 4A, the displaceable bearing house 51 has an outer cylindrical surface 55 arranged slidingly in a cylindrical boring 56 in the stationary bearing house support 52.

As furthermore seen in FIG. 4A, a pivotal side cover plate 57 is fixed on each said non-driven grate shaft end 18 journalled in an axially displaceable bearing 50. The pivotal side cover plate 57 forms part of said side wall 54 of the upper relatively narrow housing section 15 and is arranged pivotally in a cut-out 58 of the corresponding non-pivotal side cover plate 53 so that an outer edge 59 of the pivotal side cover plate 57 forming an arc of a circle (not illustrated) is in close proximity to a corresponding inner edge of the cut-out 58 of the corresponding non-pivotal side cover plate 53 forming a corresponding arc of a circle (not illustrated). Thereby, a relatively tight connection may be formed between the non-pivotal side cover plate and the grate shaft end. As seen in the cross-sectional view of FIG. 4A, the cut-out 58 and the outer edge 59 have respective mutually corresponding step-formed cross-sections so that the cut-out 58 and the outer edge 59 together form a kind of labyrinth seal. Said cross-sections may have different forms.

Because the pivotal side cover plate 57 is fixed on the grate shaft end 18, it will follow axial displacements of the grate shaft end 18 resulting from temperature changes of the grate shaft 12, and the pivotal side cover plate 57 will therefore also follow the displacements of the non-pivotal side cover plate 53.

Axially displaceable bearings 50 as discussed above may be arranged at driven shaft grate shaft ends 17 or at non-driven grate shaft ends 18. However, for structural reasons, it may be preferred to arrange such axially displaceable bearings 50 only at non-driven grate shaft ends 18. Depending on the drive mechanism, it may be advantageous that the driven grate shaft ends do not move in axial direction.

As seen in FIGS. 3, 4 and 5, a stationary frame of each midsection 8, 9, 10 is formed by means of two spaced grate beams 60 extending in the longitudinal direction of each respective midsection 8, 9, 10 in the lower relatively broad housing section 16 of said midsection. Two grate plates in the form of longitudinal L-formed brackets 61 are mounted with a first lower flange 62 on top of the respective spaced grate beams 60 and with a second upright flange 63 extending vertically, and bearing houses 51, 64 arranged in each respective midsection 8, 9, 10 are carried by the respective second upright flanges 63 of the two longitudinal L-formed brackets 61. Thereby, generally, an especially narrow upper housing section 15 of the respective midsections may be achieved. The size of the lower relatively broad housing section 16 may also be reduced by employment of the two longitudinal L-formed brackets 61.

A dust shield 65 is arranged inside an outer enclosure 66 of each respective midsection 8, 9, 10. Non-displaceable bearing houses 64 and stationary bearing house supports 52 carrying bearings 19 in which respective driven grate shaft ends 17 are journalled extend sealingly through respective openings 67 in the dust shields 65. The dust shield 65 thereby separates the inside of the outer enclosure 66 of each midsection into an outer room section 68 next to the outer enclosure 66 and an inner room section 69. In the second and third midsections 9, 10, the inner room section 69 encloses the drive mechanism 20 including the actuator 21 and the synchronising mechanism 22 of each lane section 11. Thereby, the drive mechanism including the actuator and the synchronising mechanism may be even better protected against dust and dirt possibly entering through leaks from the combustion chamber. Thereby, maintenance costs may be reduced.

The outer room section 68 is connected to a supply of pressurised sealing gas. Thereby, an overpressure in relation to the pressure in the combustion chamber 83 may be created in the outer room section 68, thereby even better preventing dust and dirt from possibly entering through leaks from the combustion chamber into the outer room section. The outer room section 68 may thereby create a barrier between the combustion chamber 83 and the inner room section 69, thereby even better preventing dust and dirt from possibly entering the inner room section enclosing the drive mechanism including the actuator and the synchronising mechanism. Thereby, maintenance costs may be even more reduced.

The dust shield 65 includes a bottom wall 70 extending between the two spaced grate beams 60, two spaced side walls 71 extending from the bottom wall 70 to a top part of the upper relatively narrow housing section 15 of the midsections 8, 9, 10 and a top wall 72 connecting the two spaced side walls 71. In the second and third midsections 9, 10, non-displaceable bearing houses 64 and stationary bearing house supports 52 carrying bearings 19 in which respective grate shaft ends 17, 18 are journalled extend sealingly through openings 67 in the respective two spaced side walls 71, and the drive mechanism 20 of each lane section 11 extends through an opening 73 in the bottom wall 70.

The bearings 19 carried by the non-displaceable bearing houses 64 and stationary bearing house supports 52 are sealed against the outer room section 68 and possibly against the inner room section 69, respectively, by means of corresponding stacks 81 of disc springs.

As seen in FIGS. 3, 4 and 5, the two spaced grate beams 60 forming the stationary frame of each respective midsection 8, 9, 10 have the form of hollow rectangular tubes, the inside 74 of the hollow rectangular tubes are connected to a supply of pressurised sealing gas, and the pressurised sealing gas is supplied to the outer room section 68 from the inside 74 of the hollow rectangular tubes through holes 75 in the walls of the hollow rectangular tubes.

In the embodiment illustrated in FIG. 1, it is seen that the main part of the grate bars 13 of the second grate lane 3 extending between the first and second midsections 8, 9 and of the third grate lane 4 extending between the second and third midsections 9, 10 are adapted to be cooled by means of circulating cooling fluid in such a way that a cooling fluid supply channel 76 is formed as an axial bore in an inlet end of the grate shafts 12 carrying grate bars 13, and a cooling fluid outlet channel 77 is formed as an axial bore in an outlet end of the grate shafts 12 carrying grate bars 13, the outlet end being opposite the inlet end. For the second grate lane 3, the cooling fluid supply channels 76 are connected to respective cooling fluid supply tubes 78 extending in the second midsection 9, and the cooling fluid outlet channels 77 are connected to respective cooling fluid return tubes 79 extending in the first midsection 8. For the third grate lane 4, the cooling fluid supply channels 76 are connected to respective cooling fluid supply tubes 78 extending in the third midsection 10, and the cooling fluid outlet channels 77 are connected to respective cooling fluid return tubes 79 extending in the second midsection 9. Thereby, the service life of the grate bars may be extended substantially. By leading the cooling fluid in from one end of the grate shafts and out of the other end, an even better cooling effect may be achieved than that compared to known devices having inlet and outlet at one single end of the grate shafts. The two outermost grate bars 13 next to the side wall 54 of upper relatively narrow housing section are not cooled.

Referring to FIG. 2, the main part of the grate bars 13 of the first grate lane 2 extending between the left side section 6 and the first midsection 8 are adapted to be cooled by means of circulating cooling fluid in such a way that a cooling fluid supply channel 90 is formed as an axial bore in the driven end of the grate shafts 12 journalled in the left side section 6 and that a cooling fluid outlet channel 91 is formed coaxially around the cooling fluid supply channel 90 in the driven end of the grate shafts 12. Cooling fluid channels are arranged in the grate shafts 12 so that cooling fluid may be circulated through the grate bars 13 one after each other in a series cooling fluid circuit. Correspondingly, the main part of the grate bars 13 of the fourth grate lane 5 extending between the right side section 7 and the third midsection 10 are adapted to be cooled by means of circulating cooling fluid in such a way that a cooling fluid supply channel is formed as an axial bore in the driven end of the grate shafts 12 journalled in the right side section 7 and that a cooling fluid outlet channel is formed coaxially around the cooling fluid supply channel in the driven end of the grate shafts 12.

Figure 12:
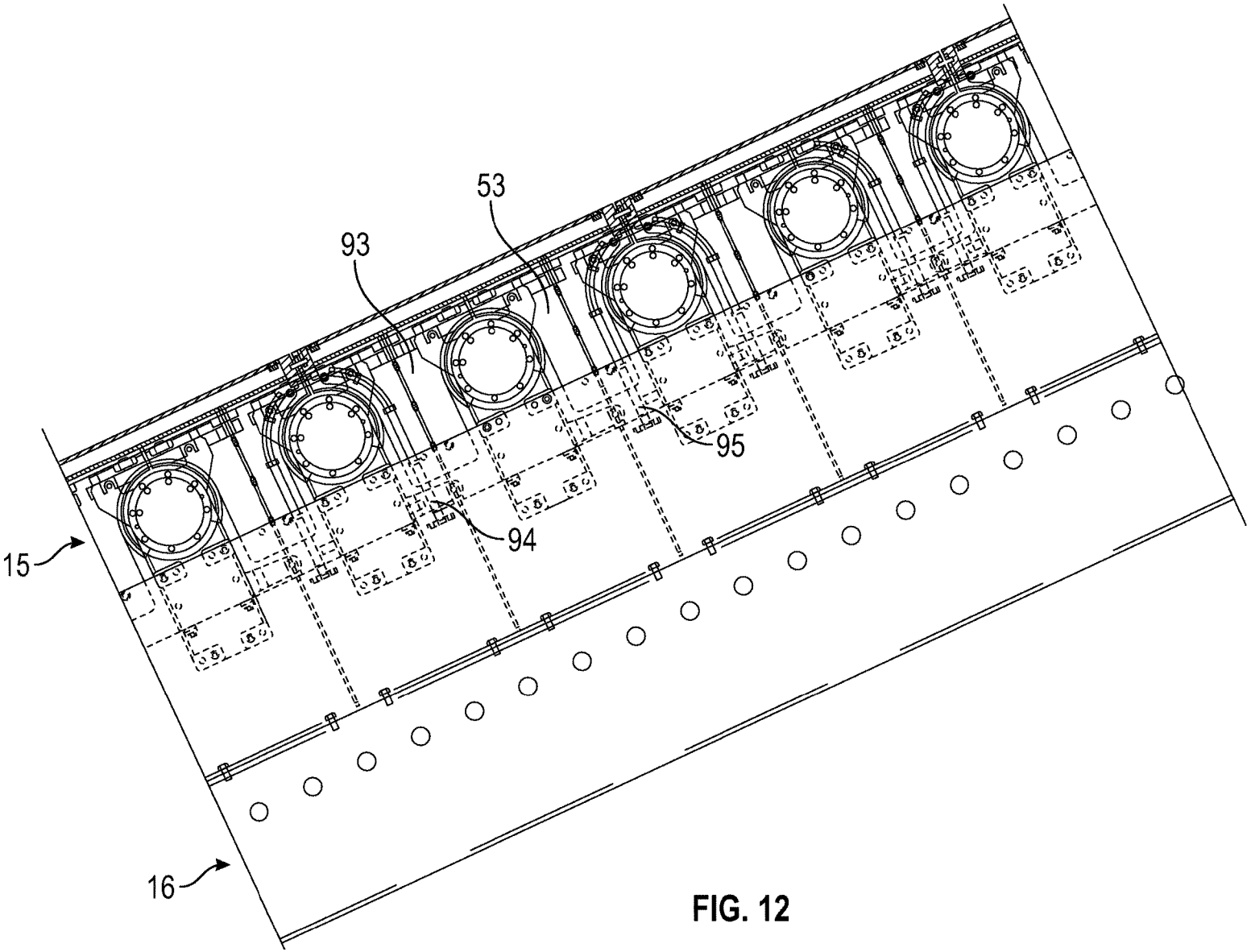
FIG. 12 illustrates the cross-section XII-XII indicated in FIG. 5.
Figure 13:
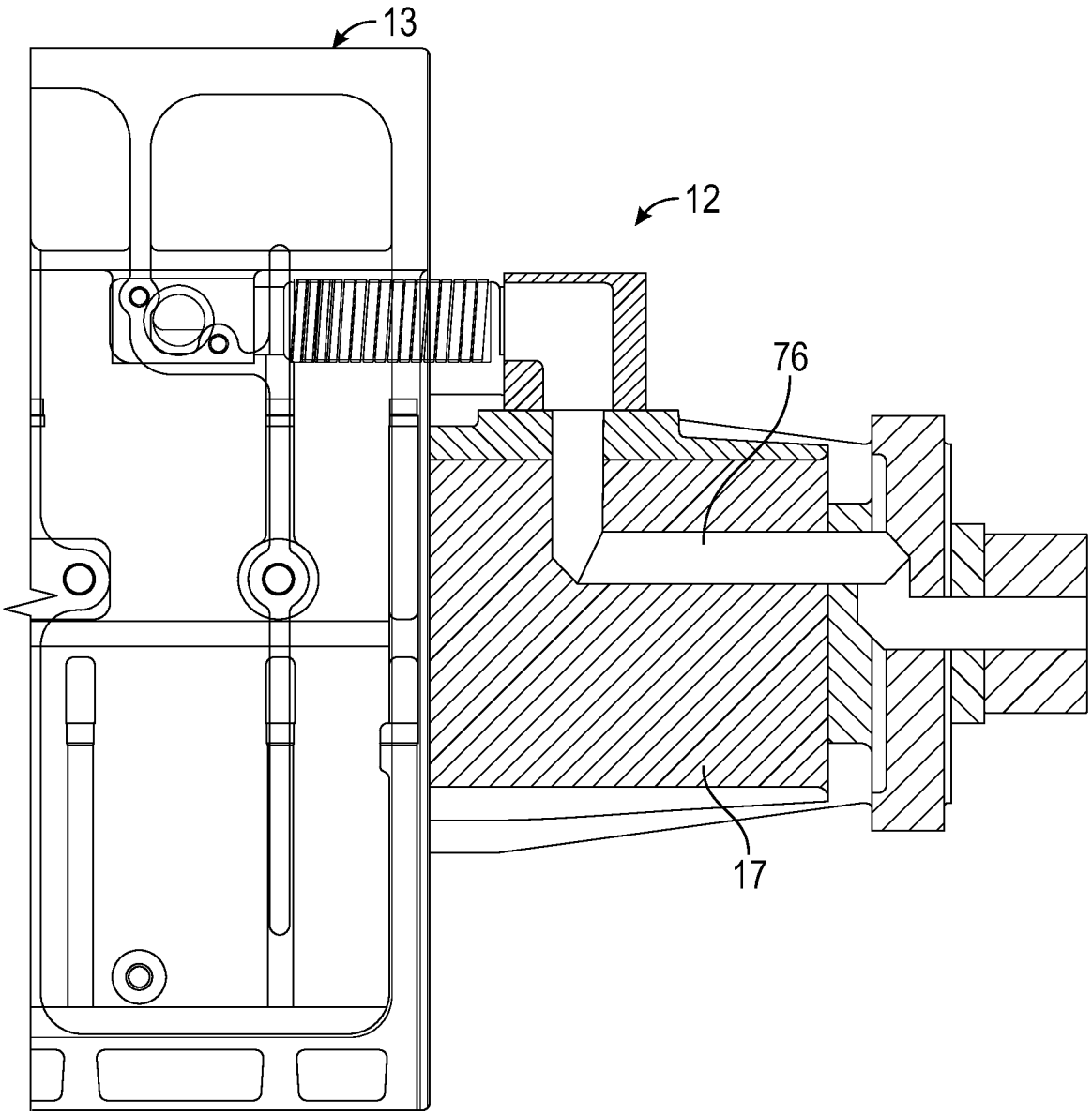
FIG. 13 illustrates the cross-section XIII-XIII indicated in FIG. 4.

Referring to FIGS. 4, 5 and 6, it is seen that the non-pivotal side cover plates 53 forming part of the right side wall 54 of the upper relatively narrow housing section 15 of each midsection 8, 9, 10 are adapted to be cooled by means of circulating cooling fluid. Thereby, the service life of the grate shaft bearings and the drive mechanisms may be extended substantially. The non-pivotal side cover plates 53 have internal cooling channels 92 as particularly visible in FIG. 4A. As seen in FIG. 12, the non-pivotal side cover plates 53 are formed as so-called T-plates 93 each forming a section of an entire side wall 54 of an upper relatively narrow housing section 15. In this case, each T-plate arranged to the right of the upper relatively narrow housing section 15 forms two T-formed areas of which the lower legs of the T-formed areas each extends between two grate shaft ends journalled in said upper relatively narrow housing section 15 and of which the upper legs of the T-formed areas together forms one long leg. A cooling fluid inlet tube 94 is arranged at a first T-formed area of each T-plate 93 and a cooling fluid outlet tube 95 is arranged at a second T-formed area of each T-plate 93.

As best seen in FIG. 4A, in the illustrated embodiment, covering units 96 having L-formed cross-section and forming part of the left side wall 54 of the upper relatively narrow housing section 15 and forming a top wall 80 of said upper relatively narrow housing section 15 are also adapted to be cooled by means of circulating cooling fluid. Thereby, the service life of the grate shaft bearings and the drive mechanisms may be further extended. It is seen that an outlet end of a cooling fluid inlet tube 94 extends inside said top wall 80 to a middle area of the top wall 80, where the cooling fluid may flow into an internal cooling channel 92 in the covering unit 96. Similarly, a cooling fluid outlet tube is arranged with an inlet end in a middle area of the top wall 80. In the area of the covering units 96 forming part of the left side wall 54 and forming the top wall 80, the cooling fluid inlet tubes 94 and the cooling fluid outlet tubes 95 are arranged corresponding to the illustration of FIG. 12.

Referring again to FIG. 4A, a pivotal side cover plate 103 is fixed on each said driven grate shaft end 17 journalled in a non-displaceable bearing house 64. The pivotal side cover plate 103 forms part of the left side wall 54 of the upper relatively narrow housing section 15 and is arranged pivotally in a cut-out 58 of the corresponding covering unit 96 so that an outer edge 59 of the pivotal side cover plate 103 forming an arc of a circle (not illustrated) is in close proximity to a corresponding inner edge of the cut-out 58 of the corresponding covering unit 96 forming a corresponding arc of a circle (not illustrated). The pivotal side cover plate 103 is fixed on the grate shaft end 17 which is arranged non-displaceably in the axial direction. Thereby, a relatively tight connection may be formed between the stationarily arranged covering unit 96 and the grate shaft end.

Furthermore, it is seen in FIG. 4A that an upper side 104 of the non-pivotal side cover plate 53 which is coupled to and axially displaceable with the displaceable bearing house 51 is arranged to slide at least substantially sealingly against a lower side edge 105 of the stationarily arranged covering unit 96.

In the embodiment illustrated in FIG. 1, the left side section 6 and the right side section 7 include the drive mechanisms 20 and the synchronising mechanisms 22 of the lane sections 11 of the left outermost grate lane 2 and of the lane sections 11 of the right outermost grate lane 5, respectively. The grate shafts 12 of the lane sections 11 of the left outermost grate lane 2 and of the lane sections 11 of the right outermost grate lane 5, respectively, are numbered consecutively in downward direction. Each grate shaft 12 is provided with a crank arm, the crank arms of grate shafts 12 having odd numbers are connected by means of a first linking rod and the crank arms of grate shafts 12 having even numbers are connected by means of a second linking rod. The actuator 21 of said drive mechanism 20 is a linear actuator, such as a hydraulic piston actuator, and the first linking rod and the second linking rod are interconnected by means of the linear actuator. In FIG. 1 and in FIG. 2 illustrating the left side section 6, the drive mechanisms 20 are only partly illustrated. However, it is understood that each drive mechanism 20 of the side sections 6, 7 corresponds to the part illustrated in FIG. 8 of the drive mechanism 20 of the midsections 8, 9, 10. In the drive mechanism 20 illustrated in FIG. 8, the crank arms $\mathbf{38}_1$, $\mathbf{38}_2$, $\mathbf{38}_3$, $\mathbf{38}_4$, $\mathbf{38}_5$, $\mathbf{38}_6$ are mounted on corresponding drive shafts $\mathbf{26}_1$, $\mathbf{26}_2$, $\mathbf{26}_3$, $\mathbf{26}_4$, $\mathbf{26}_5$, $\mathbf{26}_6$, and the driving motion is transferred to the grate shafts $\mathbf{12}_1$, $\mathbf{12}_2$, $\mathbf{12}_3$, $\mathbf{12}_4$, $\mathbf{12}_5$, $\mathbf{12}_6$ by means of connection rods 31. However, in the corresponding drive mechanisms 20 of the side sections 6, 7, the corresponding crank arms $\mathbf{38}_1$, $\mathbf{38}_2$, $\mathbf{38}_3$, $\mathbf{38}_4$, $\mathbf{38}_5$, $\mathbf{38}_6$ are mounted directly on the grate shafts $\mathbf{12}_1$, $\mathbf{12}_2$, $\mathbf{12}_3$, $\mathbf{12}_4$, $\mathbf{12}_5$, $\mathbf{12}_6$. Thereby, partly the same or corresponding drive mechanisms may be employed for both side sections and midsections, thereby reducing the number of different components. Furthermore, the respective clearance adjustment mechanisms 24 and the respective biasing mechanisms 25 illustrated in FIG. 8 and described above may also be employed in said corresponding drive mechanisms 20 of the side sections 6, 7. Thereby, the same or corresponding adjustment procedures may be employed.

As described above, in the embodiment illustrated in FIG. 1, the movable grate 1 includes a first grate lane 2, a second grate lane 3, a third grate lane 4, and a fourth grate lane 5. The left side section 6 and the right side section 7 encloses axially displaceable driven grate shaft ends 17 of the first and third grate lanes 2, 5, respectively. A first midsection 8 includes axially non-displaceable bearings for non-driven grate shaft ends 18 of the first grate lane 2 and axially displaceable bearings 50 for non-driven grate shaft ends 18 of the second grate lane 3. A second midsection 9 includes axially non-displaceable bearings for driven grate shaft ends 17 of the second grate lane 3 and axially displaceable bearings 50 for non-driven grate shaft ends 18 of the third grate lane 4. A third midsection 10 includes axially non-displaceable bearings for driven grate shaft ends 17 of the third grate lane 4 and axially non-displaceable bearings for non-driven grate shaft ends 18 of the fourth grate lane 5.

Figure 14:
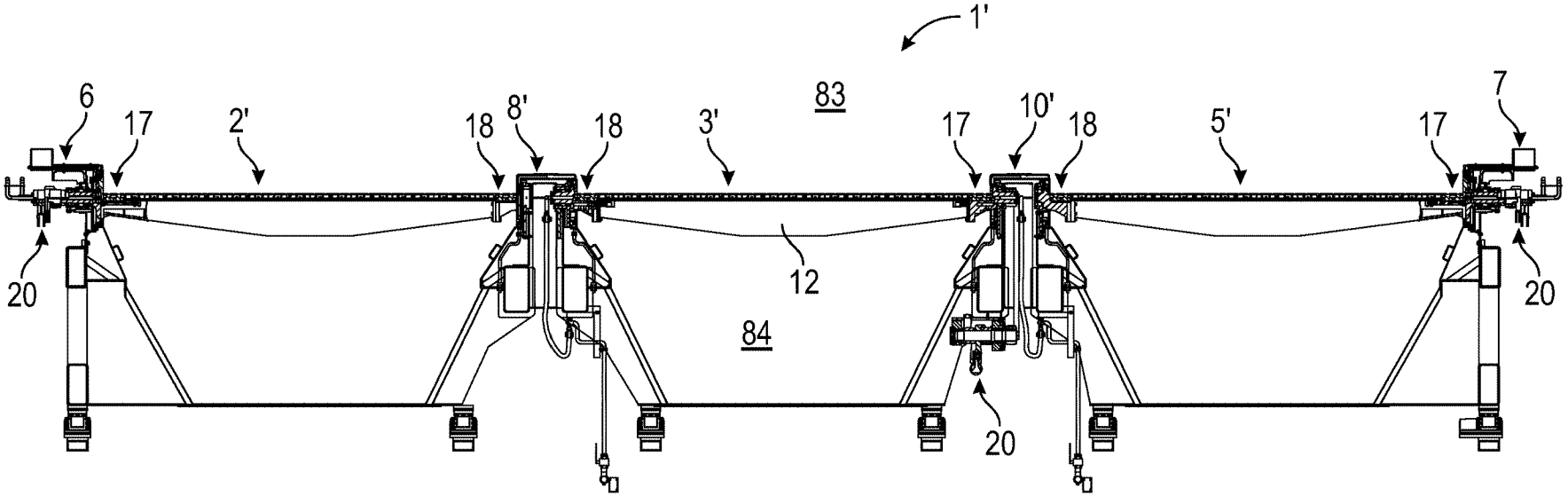
FIG. 14 is a cross-section through another embodiment of a movable grate for a furnace according to the invention, seen from the upper end of the movable grate.

FIG. 14 illustrates another embodiment of the movable grate 1 according to the invention. In this embodiment, the movable grate 1' includes a first grate lane 2', a second grate lane 3', and a third grate lane 5'. The left side section 6 and the right side section 7 includes axially displaceable bearings for driven grate shaft ends 17 of the first and third grate lanes 2', 5', respectively. A first midsection 8' includes axially non-displaceable bearings for non-driven grate shaft ends 18 of the first grate lane 2' and axially displaceable bearings for non-driven grate shaft ends 18 of the second grate lane 3'. A second midsection 10' includes axially non-displaceable bearings for driven grate shaft ends 17 of the second grate lane 3' and axially non-displaceable bearings for non-driven grate shaft ends 18 of the third grate lane 5'.

By comparing the embodiments of FIGS. 1 and 14, it may be seen that the embodiment of FIG. 1 may be converted into the embodiment of FIG. 14 by removing the second midsection 9 and forming the second grate lane 3 and the third grate lane 4 as one grate lane in the form of the second grate lane 3' of the embodiment of FIG. 14. Furthermore, it may then be understood that the left side section 6 and the right side section 7 of the embodiment of FIG. 1 correspond to the left side section 6 and the right side section 7, respectively, of the embodiment of FIG. 14. Similarly, the first midsection 8 of the embodiment of FIG. 1 corresponds to the first midsection 8' of the embodiment of FIG. 14, and the third midsection 10 of the embodiment of FIG. 1 corresponds to the second midsection 10' of the embodiment of FIG. 14.

Furthermore, it may be understood that the embodiment of FIG. 1 may be converted into another embodiment of the movable grate 1 according to the invention, in which embodiment the movable grate includes five grate lanes. This may be done by splitting up the second grate lane 3 or the third grate lane 4 into two new grate lanes separated by means of a new midsection corresponding to the second midsection 9 of the embodiment of FIG. 1. In the same way, one of these two new grate lanes may be separated by means of a further new midsection, and an embodiment having six grate lanes may be achieved. In this way, a movable grate having any larger number of grate lanes may be created. In fact, the movable grate 1 according to the invention may also have only two grate lanes. This may be done by conversion of the embodiment illustrated in FIG. 14 by removing the first midsection 8' and forming the first grate lane 2' and the second grate lane 3' as one grate lane. In this case, the drive mechanism of the left side section 6 should be removed.

According to the present invention, other embodiments than those described above and illustrated in the figures are possible. For instance, the embodiment illustrated in FIG. 1 having four grate lanes 2, 3, 4, 5 may be configured differently than illustrated. In order to minimize the number of different parts and configurations, each midsection 8, 9, 10 could be configured as the second midsection 9 of the embodiment of FIG. 1. Furthermore, the details of the left side section 6 could be configured as the details of the right half part of the second midsection 9 of the embodiment of FIG. 1, and the details of the right side section 7 could be configured as the details of the left half part of the second midsection 9 of the embodiment of FIG. 1. Of course, in this case, depending on available space, in the left and right side sections 6, 7, although the respective details thereof generally being based on the second midsection 9 as illustrated in FIGS. 4 and 4A, the connection rods 31 could be omitted and the crank arms 38 could be mounted directly on the respective grate shafts 12 as it is also the case in the embodiment of FIG. 1 as explained above. The alternative arrangement could also be the case for the supply and discharge of cooling fluid for the cooling of the grate bars 13. In the resulting alternative embodiment, the left side section 6 includes axially displaceable bearings 50 for non-driven grate shaft ends of the first grate lane 2 and the right side section 7 includes axially non-displaceable bearings for driven grate shaft ends 17 of the third grate lane 5. Furthermore, the first midsection 8 includes axially non-displaceable bearings for driven grate shaft ends 17 of the first grate lane 2 and axially displaceable bearings 50 for non-driven grate shaft ends 18 of the second grate lane 3, the second midsection 9 includes axially non-displaceable bearings for driven grate shaft ends 17 of the second grate lane 3 and axially displaceable bearings 50 for non-driven grate shaft ends 18 of the third grate lane 4, and the third midsection 10 includes axially non-displaceable bearings for driven grate shaft ends 17 of the third grate lane 4 and axially displaceable bearings 50 for non-driven grate shaft ends 18 of the fourth grate lane 5. This alternative embodiment having four grate lanes 2, 3, 4, 5 could in the way explained above easily be converted into an embodiment having three grate lanes 2', 3', 5' as illustrated in FIG. 14.

As another example, the embodiment illustrated in FIG. 1 having four grate lanes 2, 3, 4, 5 could be altered so that the left side section 6 includes axially non-displaceable bearings for driven grate shaft ends of the first grate lane 2, and the first midsection 8 includes axially displaceable bearings for non-driven grate shaft ends of the of the first grate lane 2. In the same way, additionally or alternatively, the embodiment could be altered so that the right side section 7 includes axially non-displaceable bearings for driven grate shaft ends of the fourth grate lane 5, and the third midsection 10 includes axially displaceable bearings for non-driven grate shaft ends of the of the fourth grate lane 5. Everything else could remain the same as in the embodiment illustrated in FIG. 1. This alternative embodiment having four grate lanes 2, 3, 4, 5 could also in the way explained above easily be converted into an embodiment having three grate lanes 2', 3', 5' as illustrated in FIG. 14.

The different embodiments described above may be combined in any suitable way. On the basis of the above, the skilled person will understand that many further embodiments according to the present invention are possible.

LIST OF REFERENCE NUMBERS

1 movable grate
2, 3, 4, 5 grate lane
6 left side section
7 right side section
8, 9, 10 midsection
11 lane section
$\mathbf{12}_1$, $\mathbf{12}_2$, $\mathbf{12}_3$, $\mathbf{12}_4$, $\mathbf{12}_5$, $\mathbf{12}_6$ grate shaft
13 grate bar
14 inclined grate surface
15 upper relatively narrow housing section
16 lower relatively broad housing section
17 driven grate shaft end
18 non-driven grate shaft end
19 bearing for grate shaft end
20 drive mechanism
21 actuator
22 synchronising mechanism
23 edge portions of grate bar
24 clearance adjustment mechanism
25 biasing mechanism
$\mathbf{26}_1$, $\mathbf{26}_2$, $\mathbf{26}_3$, $\mathbf{26}_4$, $\mathbf{26}_5$, $\mathbf{26}_6$ drive shaft
27 grate shaft lever arm
28 first end of grate shaft lever arm
29 second end of grate shaft lever arm
30 first end of connection rod
31 connection rod
32 second end of connection rod
33 drive shaft lever arm
34 first end of drive shaft lever arm

35 second end of drive shaft lever arm
36 first ball joint
37 second ball joint
$38_1$, $38_2$, $38_3$, $38_4$, $38_5$, $38_6$ crank arm
39 first linking rod
40 second linking rod
41 first synchronising lever arm
42 first end of first synchronising lever arm
43 second end of first synchronising lever arm
44 synchronising rod
45 first end of synchronising rod
46 second synchronising lever arm
47 first end of second synchronising lever arm
48 second end of second synchronising lever arm
49 second end of synchronising rod
50 axially displaceable bearings for grate shaft ends
51 displaceable bearing house
52 stationary bearing house support
53 non-pivotal side cover plate
54 side wall of upper relatively narrow housing section
55 outer cylindrical surface of displaceable bearing house
56 cylindrical boring in stationary bearing house support
57 pivotal side cover plate
58 cut-out of non-pivotal side cover plate
59 outer edge of pivotal side cover plate
60 grate beam
61 longitudinal L-formed bracket
62 first lower flange of longitudinal L-formed bracket
63 second upright flange of longitudinal L-formed bracket
64 non-displaceable bearing house
65 dust shield
66 outer enclosure of midsection
67 openings in side walls of dust shield
68 outer room section
69 inner room section
70 bottom wall of dust shield
71 side walls of dust shield
72 top wall of dust shield
73 opening in bottom wall of dust shield
74 inside of hollow rectangular tube
75 hole in wall of hollow rectangular tube
76 cooling fluid supply channel
77 cooling fluid outlet channel
78 cooling fluid supply tube
79 cooling fluid return tube
80 top wall of upper relatively narrow housing section
81 stack of disc springs
82 predetermined clearance between edge portions
83 combustion chamber
84 bottom ash hopper
85 set screw
86 stack of disc springs
87 transverse upper part of crank arm
88 carrier
89 coupling elements
90 cooling fluid supply channel
91 cooling fluid outlet channel
92 internal cooling channel of T-plate or covering unit
93 T-plate
94 cooling fluid inlet tube
95 cooling fluid outlet tube
96 covering unit
97 tap
98 hinge part
99 non-pivotal side cover plate of side section
100 axially displaceable grate shaft end of side section
101 axially non-displaceable bearing of grate shaft end
102 axially displaceable bearing house
103 pivotal side cover plate
104 upper side of non-pivotal side cover plate
105 lower side edge of covering unit
106 nut
107 locking nut
108 bore
109 disc spring guide
110 locking ring

The invention claimed is:

1. A movable grate for a furnace including a number of grate lanes arranged side-by-side between a left side section and a right side section, neighboring grate lanes being connected by means of a midsection, each grate lane including at least one lane section having a number of pivotal grate shafts carrying grate bars and thereby defining an inclined grate surface of said lane section, each midsection including an upper relatively narrow housing section arranged between grate bars of the corresponding neighboring grate lanes and a lower relatively broad housing section protruding at least partly wider grate bars of said corresponding neighbouring grate lanes, each grate shaft having a driven grate shaft end and a non-driven grate shaft end, each grate shaft end being journaled in a respective bearing, the left and right side sections enclosing bearings for corresponding grate shaft ends of the left and right outermost grate lanes, respectively, and the upper relatively narrow housing section, of each midsection enclosing bearings for corresponding grate shaft ends of corresponding neighbouring grate lanes, each lane section being provided with a drive mechanism including an actuator for pivoting back and forth neighboring grate shafts in opposite rotational directions so as to impart a wave-like movement to material on the grate surface in order to transport such material downwards, a synchronising mechanism being arranged to maintain a predetermined clearance between edge portions of grate bars of neighbouring grate shafts, wherein at least one midsection includes the drive mechanism and the synchronising mechanism of at least one lane section, and in that the actuator of said drive mechanism and said synchronising mechanism are located in the lower relatively broad housing section of said at least one midsection.

2. A movable grate according to claim 1, wherein, in the at least one midsection including the drive mechanism and the synchronising mechanism of the at least one lane section, the mutual relative pivotal positions of the respective grate shafts of the at least one lane section are individually adjustable by means of respective clearance adjustment mechanisms s located in the lower relatively broad housing section of said at least one midsection.

3. A movable grate according to claim 1, wherein, in the at least one midsection including the drive mechanism and the synchronising mechanism of the at least one lane section, the mutual relative pivotal positions of the respective grate shafts of the at least one lane section are individually elastically biased towards respective predetermined relative pivotal positions by means of respective biasing mechanisms located in the lower relatively broad housing section of said at least one midsection.

4. A movable grate according to claim 1, wherein, in the at least one midsection including the drive mechanism and the synchronising mechanism of the at least one lane section, a number of drive shafts corresponding to the respective grate shafts of the at least one lane section are located in the lower relatively broad housing section of said at least one midsection, and the driven grate shaft end of each said grate shaft is individually in driven connection with a corresponding one of said drive shafts.

5. A movable grate according to claim 1, wherein the driven grate shaft end of the respective grate shafts of the at least one lane section is provided with a respective grate shaft lever arm, wherein a first end of the grate shaft lever arm is in driving connection with the grate shaft and a second end of the grate shaft lever arm is pivotally connected to a first end of a corresponding connection rod extending down into the lower relatively broad housing section of said at least one midsection, and wherein a second end of said connection rod located in said relatively broad housing section is in driven connection with the actuator of said drive mechanism.

6. A movable gate according to claim 5, wherein the driven connection between the second end of said respective connection rods and the actuator of said drive mechanism is individually adjustable in order to adjust the individual predetermined clearance between edge portions of grate bars of neighbouring grate shafts.

7. A movable grate according to claim 4, wherein the driven grate shaft end of each said grate shaft is provided with a grate shaft lever arm, wherein a first end of the grate shaft lever arm is in driving connection with the grate shaft and a second end of the grate shaft lever arm is pivotally connected to a first end of a corresponding connection rod, wherein each said drive shaft is provided with a drive shaft lever arm, and wherein a first end of the drive shaft lever arm is in driven connection with the drive shaft and a second end of the drive shaft lever arm is pivotally connected to a second end of a corresponding connection rod so that each grate shaft lever arm is connected with a corresponding drive shaft lever arm by means of a corresponding connection rod.

8. A movable grate according to claim 7, wherein each connection rod is pivotally connected to the corresponding grate shaft lever arm by means of a first ball joint, and wherein each connection rod is pivotally connected to the corresponding drive shaft lever arm by means of a second ball joint.

9. A movable grate according to claim 4, wherein the grate shafts of said at least one lane section are numbered consecutively in downward direction, wherein the corresponding drive shafts are numbered correspondingly, wherein each drive shaft is provided with a crank arm, wherein the crank arms of drive shafts having odd numbers are connected by means of a first linking rod and the crank arms of drive shafts having even numbers are connected by means of a second linking rod, wherein the actuator of said drive mechanism is a linear actuator, such as a hydraulic piston actuator, and wherein the first linking rod and the second linking, rod are interconnected by means of the linear actuator.

10. A movable grate according to claim 9, wherein each crank arm is mounted pivotally adjustably on the corresponding drive shaft.

11. A movable grate according to claim 9, wherein each crank arm is mounted on the corresponding drive shaft elastically biased towards a predetermined relative pivotal position in relation to said drive shaft.

12. A movable grate according to claim 9, wherein one of the drive shafts having odd numbers is connected to one of the drive shafts having even numbers by means of the synchronising mechanism of at the least one lane section.

13. A movable grate according to claim 12, wherein said synchronising mechanism includes a first synchronising lever arm having a first end fixedly connected to said one of the drive shafts having odd numbers and a second end pivotally connected to a first end of a synchronising rod and a second synchronising lever arm having a first end fixedly connected to said one of the drive shafts having even numbers and a second end pivotally connected to a second end of the synchronising rod.

14. A movable grate according to claim 1, wherein at least one midsection includes axially displaceable bearings in which corresponding grate shaft ends of at least one lane section are journaled, wherein each said axially displaceable bearing is mounted in a displaceable bearing house mounted displaceably in relation to a stationary bearing house support mounted in fixed relationship to said at least one midsection so that said displaceable bearing house is displaceable in the axial direction of the corresponding grate shaft and fixed against rotation about said axial direction, wherein a non-pivotal side cover plate is coupled to and axially displaceable with said displaceable bearing house, wherein the non-pivotal side cover plate forms part of a side wall of the upper relatively narrow housing section of said at least one midsection including axially displaceable bearings, and wherein the non-pivotal side cover plate is mounted in proximity to the outermost grate bars carried by the grate shafts of said at least one lane section.

15. A movable grate according to claim 14, wherein the displaceable bearing house has an outer cylindrical surface arranged slidingly in a cylindrical boring in the stationary bearing house support.

16. A movable grate according to claim 14, wherein a pivotal side cover plate is fixed on each said grate shaft end journaled in an axially displaceable bearing, wherein the pivotal side cover plate forms part of said side wall of the upper relatively narrow housing section, and wherein the pivotal side cover plate is arranged pivotally in a cut-out of the corresponding non-pivotal side cover plate so that an outer edge of the pivotal side cover plate forming an arc of a circle is in close proximity to a corresponding inner edge of the cut-out of the corresponding non-pivotal side cover plate forming a corresponding arc of a circle.

17. A movable grate according to claim 14, wherein the axially displaceable bearings are arranged at non-driven grate shaft ends.

18. A movable grate according to claim 1, wherein, in the at least one midsection including the drive mechanism and the synchronising mechanism of the at least one lane section, a stationary frame of said midsection is formed by means of two spaced grate beams extending in the longitudinal direction of said midsection in the lower relatively broad housing section of said midsection, wherein two grate plates in the form of longitudinal L-formed brackets are mounted with a first lower flange on top of the respective spaced grate beams and with a second upright flange extending vertically, and wherein bearing houses arranged in said midsection are carried by the respective second upright flanges of the two longitudinal L-formed brackets.

19. A movable grate according to claim 1, wherein, in the at least one midsection including the drive mechanism and the synchronising mechanism of the at least one lane section, a dust shield is arranged inside an outer enclosure of the at least one midsection, wherein non-displaceable bearing houses or stationary bearing house supports carrying bearings in which respective driven grate shaft ends are journaled extend sealingly through respective openings in the dust shield, wherein the dust shield thereby separates the inside of the outer enclosure of the at least one midsection into an outer room section next to the outer enclosure and an inner room section enclosing the drive mechanism including the actuator and the synchronising mechanism of at least one lane section.

20. A movable grate according to claim 19, wherein the outer room section connected to a supply of pressurised seating gas.

21. A movable grate according to claim 18, wherein the dust shield includes a bottom wall extending between the two spaced grate beams, two spaced side walls extending from the bottom wall to a top part of the upper relatively narrow housing section of said midsection and a top waft connecting the two spaced side walls, wherein non-displaceable bearing houses or stationary bearing house supports carrying bearings in which respective grate shaft ends are journaled extends sealingly through openings in the respective two spaced side walls, and wherein the drive mechanism of the at least one lane section extends through an opening in the bottom wall.

22. A movable grate according to claim 21, wherein the two spaced grate beams forming the stationary frame of said midsection have the form of hollow rectangular tubes, wherein the inside of the hollow rectangular tubes are connected to a supply of pressurised sealing gas, and wherein the pressurised sealing gas is supplied to the outer room section from the inside of the hollow rectangular tubes through holes in the walls of the hollow rectangular tubes.

23. A movable grate according to claim 1, wherein at least some of the grate bars of at least one grate lane extending between two midsections are adapted to be cooled by means of circulating cooling fluid, wherein a cooling fluid supply channel is formed as an axial bore in an inlet end of the grate shafts carrying grate bars and a cooling fluid outlet channel is formed, as an axial bore in an outlet end of the grate shafts carrying grate bars, wherein the cooling fluid supply channels are connected to respective cooling fluid supply tubes extending in one of the two midsections, and wherein the cooling fluid outlet channels are connected to respective cooling fluid return tubes extending in the other of the two midsections.

24. A movable grate according to claim 14, wherein the non-pivotal side cover plates forming part of the side wall of the upper relatively narrow housing section of, said at least one midsection and a top wall of said upper relatively narrow housing section are adapted to be cooled by means of circulating cooling fluid.

25. A movable grate according to claim 1, wherein the left side section and the right side section include the drive mechanisms and the synchronising mechanisms of at, least one lane section of the left outermost grate lane and of at least one lane section of the right outermost grate lane, respectively, wherein the grate shafts of said at least one lane section of the left outermost grate lane and of said at least one lane section of the right outermost grate lane, respectively, are numbered consecutively in downward direction, wherein each grate shaft is provided with a crank arm, wherein the crank arms of grate shafts having odd numbers are connected by means of a first linking rod and the crank arms of grate shafts having even numbers are connected by means of a second linking rod, wherein the actuator of said drive mechanism is a linear actuator, such as a hydraulic piston actuator, and wherein the first linking rod and the second linking rod are interconnected by means of the linear actuator.

26. A movable grate according to claim 1, wherein the movable grate includes a first grate lane, a second grate lane, and a third grate lane, wherein the left side section and the right side section includes axially displaceable bearings for driven grate shaft ends of the first and third grate lanes, respectively, wherein a first midsection includes axially non-displaceable bearings for non-driven grate shaft ends of the first grate lane and axially displaceable bearings for non-driven grate shaft ends of the second grate lane, and wherein a second midsection includes axially non-displaceable bearings for driven grate shaft ends of the second grate lane and axially non-displaceable bearings for non-driven grate shaft ends of the third grate lane.

27. A movable grate according to claim 1, wherein the movable grate includes a first grate lane, a second grate lane, a third grate lane, and a fourth grate lane, wherein the left side section and the right side section encloses axially displaceable driven grate shaft ends of the first and fourth grate lanes, respectively, wherein a first midsection includes axially non-displaceable bearings for non-driven grate shaft ends of the first grate lane and axially displaceable bearings for non-driven grate shaft ends of the second grate lane, wherein a second midsection includes axially non-displaceable bearings for driven grate shaft ends of the second grate lane and axially displaceable bearings for non-driven grate shaft ends of the third grate lane, and wherein a third midsection includes axially non-displaceable bearings for driven grate shaft ends of the third grate lane and axially non-displaceable bearings for non-driven grate shaft ends of the fourth grate lane.

* * * * *